US005844531A

United States Patent [19]

Betsui

[11] Patent Number: 5,844,531

[45] Date of Patent: Dec. 1, 1998

[54] FLUORESCENT DISPLAY DEVICE AND DRIVING METHOD THEREOF

[75] Inventor: Keiichi Betsui, Kawasaki, Japan

[73] Assignee: Fujitsu Limited, Kawasaki, Japan

[21] Appl. No.: 414,627

[22] Filed: Mar. 31, 1995

[30] Foreign Application Priority Data

Jun. 21, 1994 [JP] Japan ..... 6-138912

[51] Int. Cl.[6] ..... G09G 3/28; H01J 1/02

[52] U.S. Cl. ..... 345/75; 345/55; 315/169.3

[58] Field of Search ..... 313/309, 491, 313/422, 497; 345/74, 75, 55, 204; 315/169.1, 169.3

[56] References Cited

U.S. PATENT DOCUMENTS

| | | | |
|---|---|---|---|
| 3,952,221 | 4/1976 | Kamegaya et al. | 313/491 |
| 4,322,659 | 3/1982 | De Jule et al. | 315/169.1 |
| 4,459,514 | 7/1984 | Morimoto et al. | 345/75 |
| 4,486,749 | 12/1984 | Kishino et al. | 345/75 |
| 4,540,983 | 9/1985 | Morimoto et al. | 345/75 |
| 4,801,850 | 1/1989 | Kazan | 315/169.3 |
| 4,935,670 | 6/1990 | Watanabe | 345/75 |
| 5,214,346 | 5/1993 | Komatsu | 313/309 |
| 5,347,292 | 9/1994 | Ge et al. | 345/74 |
| 5,541,473 | 7/1996 | Duboc, Jr. et al. | 313/422 |
| 5,541,478 | 7/1996 | Troxell et al. | 345/75 |
| 5,572,041 | 11/1996 | Betsui et al. | 345/74 |
| 5,587,720 | 12/1996 | Fukuta et al. | 345/75 |
| 5,633,650 | 5/1997 | Kishino et al. | 345/74 |

FOREIGN PATENT DOCUMENTS

| | | |
|---|---|---|
| 0 349 425A1 | 1/1990 | European Pat. Off. . |
| 0 349 426A1 | 1/1990 | European Pat. Off. . |
| 2 704 967 | 11/1994 | France . |
| 2 708 380 | 2/1995 | France . |
| 2-61946 | 3/1990 | Japan . |
| 3-122952 | 5/1991 | Japan . |
| 5-313600 | 11/1993 | Japan . |

OTHER PUBLICATIONS

Patent Abstracts of Japan, vol. 18, No. 129 (P–1703), Mar. 3, 1994 & JP 05 313600 A.

*Primary Examiner*—Steven Saras
*Assistant Examiner*—John Suraci
*Attorney, Agent, or Firm*—Nikaido, Marmelstein, Murray & Oram LLP

[57] ABSTRACT

A fluorescent display device is disclosed which includes: a cathode unit including a plurality of cathodes arranged in a matrix array; an anode unit including first and second groups of anode electrodes disposed above the cathode unit, arranged parallel to each other and coated with a fluorescent substance, the anode electrodes of each group being connected commonly with each other by wiring, the anode electrodes of one of the first and second groups being disposed as alternating with those of the other group; a voltage applying circuit for applying voltages of opposite polarities respectively to the first and second anode portions and alternating the polarities of the voltages; and a display controlling circuit for controlling electron emitting positions on the cathode unit and said voltage applying circuit.

9 Claims, 15 Drawing Sheets

A 2
2 6 anode
28'
wiring portion
blue phosphor
red phosphor
green
phosphor
2 1 anode
plate
a11
a21
a12
a22
G
GR
GB
GR
GB
GR
GB
R
2 7' electrodes
2 7 electrodes
A 1
2 6 anode
28
wiring portion
BG/RG/BG/RG/BG/RG/BG/RG
V g 1
2 5 gate
electrodes
2 2 cathode plate
2 3 emitter tips
2 4 emitter electrode lines
V e 1
V e 2
V e 3
V e 4

1 frame
anode electrodes
V a0
green-displaying field
t

V b0
red-and-blue displaying field
t gate electrode lines
Vg1
0
t

Vg2
0
t

Vg3
0
t

Vg4
0
t emitter electrode lines
0
Ve1
G G R R G
t

0
Ve2
G G B B G
t

0
Ve3
G R
t

0
Ve4
G B
t 1 frame
green
anode electrodes
Va 0
t red
blue
Vb 0
t gate electrode lines
Vg1
[A]
0
t Vg2
[B]
0
t Vg3
[C]
0
t Vg4
[D]
0
t emitter electrode lines
0
Ve1
G R R G
t 0
Ve2
G B G B
t 0
Ve3
R G
t 0
Ve4
B G
t phosphor screen gate hole
1 μm
104
insulation film
101 emitter tip
1 μm
102
gate electrode
103
emitter electrode

FLUORESCENT DISPLAY DEVICE AND DRIVING METHOD THEREOF

BACKGROUND OF THE INVENTION

1. Field of the Invention

The present invention relates to fluorescent display devices and driving methods thereof. More particularly, the present invention relates to a novel device configuration suitable for fluorescent display using a field-emission type element for the cathode thereof, and driving methods thereof.

2. Description of Related Art

Micro cold-cathodes adapted to emit electrons are used for display devices or micro vacuum tubes. The micro vacuum tubes offer a high electron mobility and are highly resistant to high-speed operation, high-temperature operation and radiation damage, compared with semiconductor devices. Accordingly, the micro cold-cathodes can be used in radiation environments (in space, nuclear reactors, etc.) and high-temperature environments. The expected applications thereof include micro-wave elements, very-high-speed arithmetic elements, display devices and the like. In particular, the application to display devices is now attracting great attention, as high-brightness and low energy consumption are promised.

FIG. 12(*a*) and 12(*b*) show the structure of a field emission cathode, which is one type of micro cold-cathodes conventionally used in vacuum micro devices. As shown, the field emission cathode includes sharp emitter tips 101, gate electrode 102 for attracting electrons, emitter electrode 103 for applying a negative voltage to the emitter tips, and an insulation film 104 isolating the gate electrode from the emitter electrode. When a voltage is applied between the emitter tips 101 and the gate electrode 102, a large electric field is applied to the cone tips of the emitter tips, which emit electrons.

FIG. 13 shows the structure of a flat panel display (fluorescent display device) using a field emission cathode of this type. The flat panel display comprises emitter electrodes 103 formed into a striped pattern on a cathode plate 106 disposed on the lower side and gate electrodes 102 formed perpendicular to the emitter electrodes for applying a voltage through an insulation film for attracting electrons.

FEA (field emitter array) elements are formed in intersection areas where the emitter electrodes cross the gate electrodes. When electrons emitted from FEA elements impinge on a fluorescent substance covering a glass substrate or anode plate on the upper side, the fluorescent substance emits light to display letters and the like.

Where the display device is used for color display, the anode plate 105 is coated with three kinds of fluorescent substances respectively exhibiting the three primary colors as shown in FIG. 13.

These fluorescent substances are independently excited by electrons emitted from the corresponding FEA elements to emit their respective color lights.

FIG. 14 is a sectional view of a conventional flat panel color display. In this conventional display, three kinds of fluorescent substances respectively exhibiting the three primary colors are applied on an anode plate 105 with the three-color sequence being repeated across the plate, and FEA elements for causing the fluorescent substances to emit their respective color lights are provided below the areas coated with the fluorescent substances as coinciding therewith. With the conventional construction shown in FIG. 14, however, electrons emitted from an FEA affect the neighboring fluorescent areas, thereby blurring colors.

More specifically, the electrons emitted from the FEA element are attracted to the anode and, at this time, the electron beam is somewhat flared. The spacing between adjacent fluorescent areas is so small (typically several micrometers) that the electrons inevitably impinge on the neighboring fluorescent areas as well and the fluorescent substance applied thereon emit light to some extent.

Though the fluorescent areas on the anode plate 105 and the corresponding emitter electrode lines 103 on the cathode plate 106 need to be positioned in exact alignment with each other, precise positioning between the vertically disposed plates is very difficult.

Various methods for preventing the color blurring have been proposed. One such method, which is shown in FIG. 15, is disclosed in Japanese Unexamined Patent Publication HEI 2(1990)-61 946. As shown, three kinds of fluorescent substances for the three primary colors are respectively applied on three separate anode conductive films. To display one color, the potential of one anode conductive film exhibiting that color is so adjusted to attract electrons, while the potentials of the anode conductive films exhibiting the other colors are so adjusted not to attract electrons.

The method shown in FIG. 15 solves the problem of the color blurring by allowing only one color light to be emitted at a time. However, it is necessary to apply a high voltage (typically +400 V) to the respective anode conductive films for sequentially switching the three primary colors, and hence high-voltage-resistant switching elements are required. Further, since the anode plate comprises three separate conductive films, the crossing of wiring is inevitable, thereby complicating the production process of the anode plate.

Japanese Unexamined Patent Publication HEI 5(1993)-313600 discloses a driving method of flat display in which, when a fluorescent area for one color above one gate electrode line is excited for color light emission, the flaring of the electron beam emitted from an FEA element is prevented by applying a negative potential to gates adjacent to that gate electrode line.

According to this driving method, the electron beam is prevented from reaching the adjacent fluorescent areas exhibiting the other colors.

Further, even if the anode plate is not positioned in exact alignment with the cathode plate, only a desired fluorescent area can be excited for light emission. However, this method also suffers from the following problems.

(1) Since the driver circuit for the gate electrodes is required to output both positive and negative voltages, the driver circuit becomes more complicated and expensive.

(2) Dedicated emitters for respective colors are required and, in addition, these emitters cannot be simultaneously actuated. More specifically, the actuation time of the emitters is one third that of the simplest driving method conventionally employed for constant emitter driving, and the current emission required for obtaining the same brightness is tripled.

(3) The voltage applied to the adjacent gates should be precisely adjusted in accordance with the mis-alignment degree between the anode plate and cathode plate. The problem of mis-alignment still exists.

SUMMARY OF THE INVENTION

In accordance with the present invention, there is provided a fluorescent display device which comprises: a cathode unit including a plurality of cathodes arranged in a matrix array; an anode unit including first and second groups of anode electrodes disposed above the cathode unit, arranged parallel to each other and coated with a fluorescent substance, the anode electrodes of each group being connected commonly to each other by wiring, the anode electrodes of one of the first and second groups being disposed as alternating with those of the other group; a voltage applying means for applying voltages of opposite polarities respectively to the first and second groups of anode electrodes and alternating the polarities of the voltages; and a display controlling means for controlling electron emitting positions on the cathode unit and the voltage applying means.

Preferably, the plurality of cathodes include a plurality of emitter electrode lines each having a plurality of emitter tips, and a plurality of gate electrode lines formed perpendicular to the emitter electrode lines for attracting electrons emitted from the emitter tips, with an insulation film being interposed therebetween; the emitter electrode lines extend parallel to the anode electrodes of the anode unit, and are disposed so that each of the emitter electrode lines corresponds in width to two adjacent anode electrodes of the anode unit; the fluorescent substance includes a fluorescent substance of a first color, a fluorescent substance of a second color and a fluorescent substance of a third color, which respectively represent the three primary colors; the anode electrodes of the anode unit are respectively coated with the fluorescent substance of the first color, the fluorescent substance of the second color, the fluorescent substance of the first color and the fluorescent substance of the third color in this order, and this color sequence is repeated; and anode electrodes coated with the fluorescent substance of the first color constitute the first group of anode electrodes and are all interconnected so as to have an equal potential, while anode electrodes coated with the fluorescent substance of the second color and the fluorescent substance of the third color constitute the second group of anode electrodes and are all interconnected so as to have an equal potential.

The voltage applying means drives the first and second groups of anode electrodes of the fluorescent display device in accordance with the following driving method of the present invention.

In a first light emission mode for exciting the fluorescent substance of the first color for emission of first color light, the voltage applying means applies a voltage to the first group of anode electrodes to adjust the potential thereof to a level that allows the anode electrodes of the first group to attract electrons emitted from the cathode and, at the same time, applies a voltage to the second group of anode electrodes to adjust the potential thereof to a level that prevents the electrons emitted from the cathode from reaching the anode electrodes of the second group. In a second light emission mode for exciting the fluorescent substances of the second and third colors for emission of their respective color lights, the voltage applying means applies a voltage to the second group of anode electrodes to adjust the potential thereof to a level that allows the anode electrodes of the second group to attract electrons emitted from the cathode and, at the same time, applies a voltage to the first group of anode electrodes to adjust the potential thereof to a level that prevents the electrons emitted from the cathode from reaching the anode electrodes of the first group.

In accordance with this driving method of a fluorescent display, voltages of opposite polarities are respectively applied to any two adjacent anode electrodes, and any anode electrodes under negative voltage application repel electrons, so that the electrons cannot reach the anode electrodes under negative voltage application. Thus, the color blurring can be prevented.

DETAILED DESCRIPTION OF THE PREFERRED EMBODIMENTS

Figure 1:
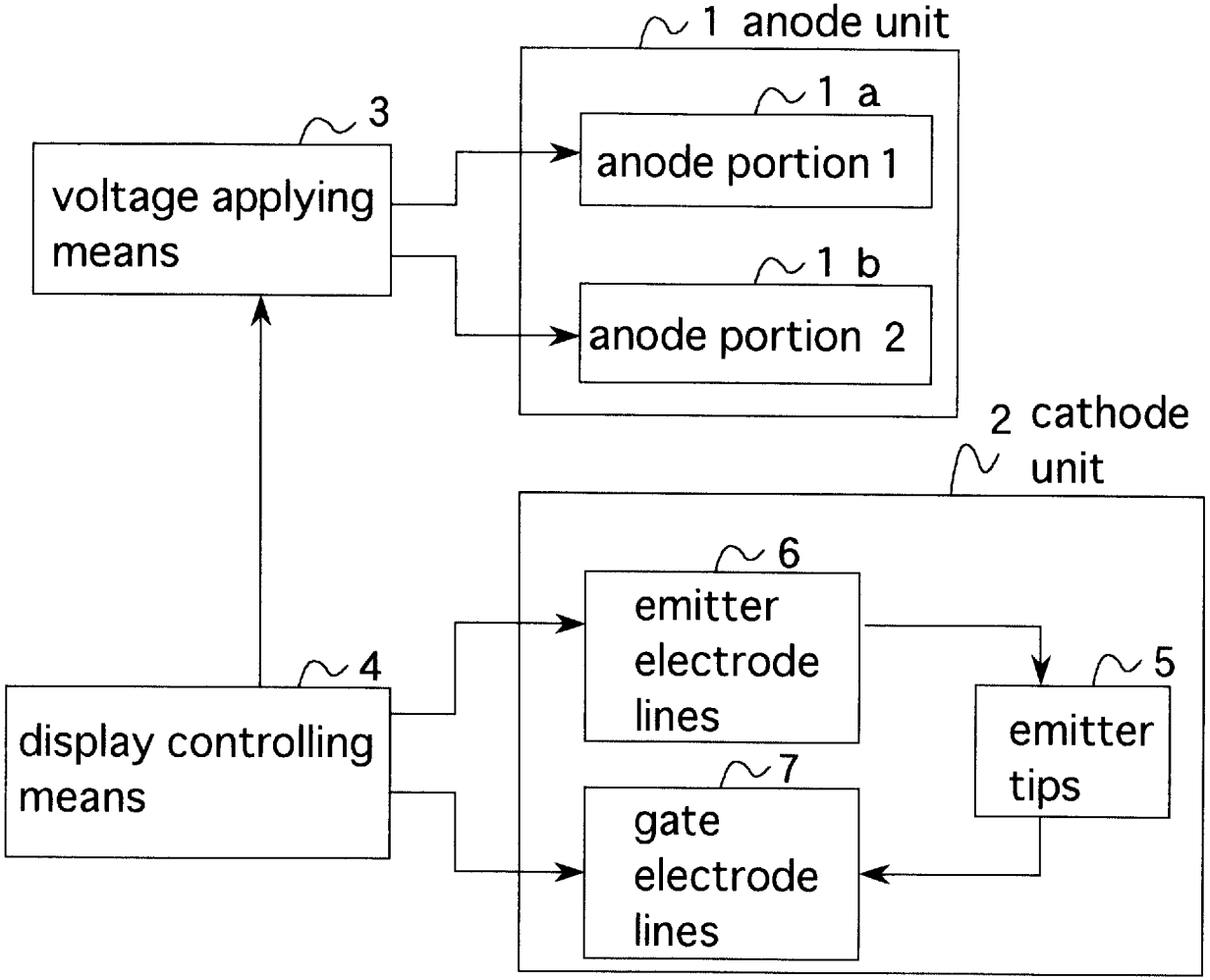
FIG. 1 is a block diagram of a fluorescent display device of the present invention.

FIG. 1 is a block diagram of a fluorescent display device of the present invention.

As shown, the fluorescent display device comprises: a cathode unit 2 including a plurality of cathodes arranged in a matrix array; an anode unit 1 including first and second groups of anode electrodes disposed above the cathode unit, arranged parallel to each other and coated with a fluorescent substance, the anode electrodes of each group being connected commonly with each other by wiring, the anode electrodes of one of the first and second groups being disposed as alternating with those of the other group; a voltage applying means 3 for applying voltages of opposite polarities respectively to the first and second groups of anode electrodes and alternating the polarities of the voltages; and a display controlling means 4 for controlling electron emitting positions on the cathode and the voltage applying means 3.

The plurality of cathodes include a plurality of emitter electrode lines 6 each having a plurality of emitter tips 5, and a plurality of gate electrode lines 7 formed perpendicular to the emitter electrode lines 6 for attracting electrons emitted from the emitter tips 5, with an insulation film being interposed therebetween; the emitter electrode lines 6 extend parallel to the anode electrodes of the anode unit 1, and are disposed so that each of the emitter electrode lines 6 corresponds in width to two adjacent anode electrodes of the anode unit 1; the fluorescent substance includes a fluorescent substance of a first color, a fluorescent substance of a second color and a fluorescent substance of a third color, which respectively represent the three primary colors; the anode electrodes of the anode unit 1 are respectively coated with the fluorescent substance of the first color, the fluorescent substance of the second color, the fluorescent substance of the first color and the fluorescent substance of the third-color in this order, and this color sequence is repeated; and anode electrodes coated with the fluorescent substance of the first color constitute the first group 1*a* of anode electrodes and are all interconnected so as to have an equal potential, while anode electrodes coated with the fluorescent substance of the second color and the fluorescent substance of the third color constitute the second group 1*b* of anode electrodes and are all interconnected so as to have an equal potential.

Preferably, the plane including anode unit 1 is disposed opposite and parallel to the plane including cathode unit 2, with the emitter electrode lines 6 of the cathode being located generally just below the second group 1*b* of anode electrodes coated with the fluorescent substance of the second color and the fluorescent substance of the third color.

Alternatively, the plurality of cathodes may include a plurality of emitter electrode lines 6 each having a plurality of emitter tips, and a plurality of gate electrode lines 7 formed perpendicular to the emitter electrode lines 6 for attracting electrons emitted from the emitter tips, with an insulation film being interposed therebetween, and wherein the gate electrode lines 7 extend parallel to the anode electrodes of the anode unit 1, and are disposed so that a single gate electrode line 7 corresponds in width to two adjacent anode electrodes of the anode unit 1, and wherein the anode electrodes of each of the first and second groups 1*a* and 1*b* coated with the fluorescent substance are all interconnected by wiring so as to have an equal potential.

Further, the voltage applying means 3 preferably comprises a transformer connected to the anode unit 1 including the first and second groups 1*a* and 1*b* of anode electrodes on the secondary coil side thereof so that voltages of opposite polarities are alternately applied respectively to the first and second groups 1*a* and 1*b* of anode electrodes.

The display controlling means 4 drives the emitter electrode lines 6 of the fluorescent display device of the present invention in the following manner.

In the fluorescent display device having the emitter electrode lines 6 formed on the cathode generally just below the second group of anode electrodes respectively coated with the fluorescent substance of the second or third color, when the fluorescent substance of the first color is to be excited for emission of the first color light, the display controlling means 4 applies a predetermined negative potential to all the emitter electrode lines 6 corresponding to the anode electrodes of the first group coated with the fluorescent substance of the first color. When the fluorescent substance of the second color is to be excited for emission of the second color light, the display controlling means 4 applies a predetermined negative potential to the emitter electrode lines 6 disposed generally just below the anode electrodes of the second group coated with the fluorescent substance of the second color. When the fluorescent substance of the third color is to be excited for emission of the third color light, the display controlling means 4 applies a predetermined negative potential to the emitter electrode lines 6 disposed generally just below the anode electrodes of the second group coated with the fluorescent substance of the third color.

By thus driving the fluorescent display device, color blurring can be prevented. In addition, the production process can be simplified without the need for the precise positioning of the anode unit relative to the cathode unit.

In a driving method of a fluorescent display device of the present invention, one frame for displaying one screen includes a first field for exciting the fluorescent substance of the first color for emission of the first color light and a second field for exciting the fluorescent substances of the second and third colors for emission of the second and third color lights. In the first field, the voltage applying means 3 applies voltages of the first light emission mode respectively to the first and second groups of anode electrodes, and the display controlling means 4 applies a predetermined negative potential to the emitter electrode lines 6 allowing pixels to exhibit the first color in synchronization with the scanning of the gate electrode lines 7 to drive the first group of anode electrodes coated with the fluorescent substance of the first color. In the second field, the voltage applying means 3 applies voltages of the second light emission mode respectively to the first and second groups of anode electrodes, and the display controlling means 4 applies a predetermined negative potential to the emitter electrode lines 6 allowing pixels to exhibit the second or third color in synchronization with the scanning of the gate electrode lines 7 to drive the second group of anode electrodes coated with the fluorescent substances of the second and third colors.

The method of thus driving the anode electrodes, emitter electrode lines and gate electrode lines can produce a fluorescent display device free from color blurring.

In an alternative driving method, the display controlling means 4 scans n gate electrode lines 7 in succession with predetermined time intervals in one frame for displaying one screen. In a first or second half of a scanning period I of an i-th (i=1 to N) gate electrode line 7, the voltage applying means 3 applies the voltages of the first light emission mode respectively to the first and second groups of anode electrodes, and the display controlling means 4 applies a predetermined negative potential to the emitter electrode lines 6 allowing pixels to exhibit the first color to drive the first group of anode electrodes coated with the fluorescent substance of the first color. In the second or first half of the scanning period I of the i-th (i=1 to N) gate electrode line 7, the voltage applying means 3 applies the voltages of the second light emission mode respectively to the first and second groups of anode electrodes, and the display controlling means 4 applies a predetermined negative potential to the emitter electrode lines 6 allowing pixels to exhibit the second or third color to drive the second group of anode electrodes coated with the fluorescent substances of the second and third colors.

Such driving method can produce a fluorescent display device free from color blurring and residual color image.

In accordance with the present invention, the anode unit 1 comprises two groups of anode electrodes and, hence, the wiring between the anode electrodes and the voltage applying means 3 do not cross with each other. This simplifies the construction of the circuit pattern of the anode unit 1, thereby simplifying the production process.

Further, since voltages of opposite polarities are constantly applied respectively to those two groups of anode electrodes for the driving thereof, a step-up transformer can be employed instead of expensive high-voltage-resistant switching elements. Therefore, an inexpensive and simplified circuit configuration can be employed for driving the anode unit 1.

With reference to the attached drawings, the present invention will hereinafter be detailed by way of embodiments thereof. These embodiments are illustrative of the invention and are not intended to be limitative thereof.

Figure 2:
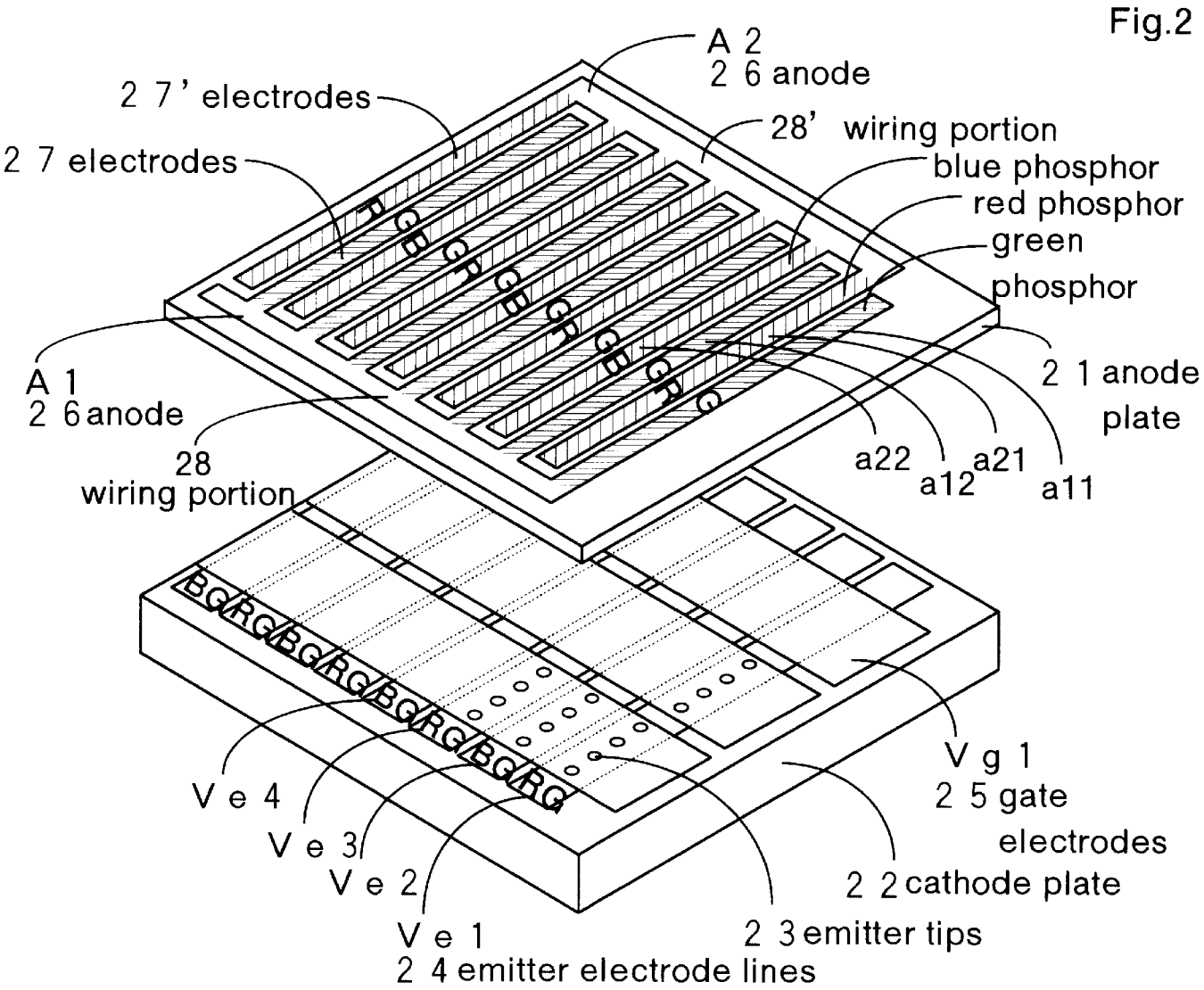
FIG. 2 is a perspective view of a fluorescent display device in accordance with one embodiment of the present invention.

FIG. 2 is a perspective view illustrating a display panel portion of a fluorescent display device in accordance with one embodiment of the present invention. This embodiment is designed for color display, but can be applied to monochromic display.

As shown, the display panel portion comprises an anode plate 21 and cathode plate 22. The anode plate 21 means the anode unit, and the cathode plate 22 means the cathode unit.

More specifically, the anode plate 21 is opposedly spaced apart from the cathode plate 22 by a predetermined distance by means of spacers (not shown), and the periphery thereof is sealed with a frit material. Thus, the anode plate 21 and cathode plate 22 cooperatively define an airtight vessel, the inside of which is a vacuum.

Emitter electrode lines 24 (or data signal lines) for selecting pixel positions for light emission are disposed perpendicular to gate electrode lines 25 (or address lines) on the cathode plate 227 and a plurality of emitter tips 23 which constitute a field emission cathode array are disposed in intersection areas where the emitter electrode lines 24 cross the gate electrode lines 25.

The emitter electrode lines 24 and the gate electrode lines 25 and a plurality of emitter tips 23 constitute a cathode. The cathode plate 22 (cathode unit) has a plurality of cathodes.

Though only four emitter tips are shown at each intersection in FIG. 2, about 1000 emitter tips may be employed in a practical application.

A plurality of field emission cathode arrays are disposed along the emitter electrode lines 24 and gate electrode lines 25 on the cathode plate 22 and arranged in a matrix configuration.

Two anode electrodes A1 and A2 of the anode 26 are formed of transparent conductive films on the anode plate 21 in striped patterns parallel to the emitter electrode lines 24 and each include a plurality of anode electrode strips 27 and 27' respectively coated with three kinds of fluorescent substances representing the three primary colors.

For example, the green fluorescent substance is preferably ZnS:Cu,Al+In2O3, the red fluorescent substance is preferably (Zn0.2,Cd0.8)S:Ag,Cl+In2O3, and the blue fluorescent substance is preferably ZnS:Zn+In2O3.

As shown in FIG. 2, the electrode strips 27 are connected to a wiring portion 28 of the anode electrode A1, and the electrode strips 27' are connected to a wiring portion 28' of the anode electrode A2. For example, electrode strips a11, a12, a13, . . . are electrically interconnected in the anode electrode A1, and electrode strips a21, a22, a23, . . . are electrically interconnected in the anode electrode A2. The electrode strips 27 of the anode electrode A1 are arranged in alternate relation with the electrode strips 27' of the anode electrode A2 in a plane. These two anode electrodes A1 and A2 are connected to a power circuit for simultaneously applying voltages of opposite polarities thereto, which will be described later.

As previously mentioned, the electrode strips 27 and 27' of the anode electrodes A1 and A2 are respectively coated with three kinds of fluorescent substances representing the three primary colors in a repeated color sequence of green-red-green-blue. For example, the electrode strips a11, a21, a12 and a22 are coated with green fluorescent substance, red fluorescent substance, green fluorescent substance and blue fluorescent substance, respectively, and this green-red-green-blue color sequence is repeated, as shown in FIG. 2.

The emitter electrode lines 24 on the cathode plate 22 are disposed so that each of the emitter signal lines 24 is vertically aligned with two adjacent electrode strips 27 and 27' on the anode plate 21.

For example, an emitter electrode line Ve1 for green and red light emission is disposed below the anode electrode strips a11 and a21 parallel thereto, while an emitter electrode line Ve2 for green and blue light emission is disposed below the anode electrode strips a12 and a22 parallel thereto. The emitter electrode lines Ve1, Ve3, . . . for green and red light emission are arranged in alternate relation with the emitter electrode lines Ve2, Ve4, . . . for green and blue light emission.

Pixels or display units are formed in intersection areas where the emitter electrode lines cross the gate electrode lines on the cathode plate. In accordance with the embodiment shown in FIG. 2, for example, intersection areas where one gate electrode line (e.g., Vg1) crosses two emitter electrode lines (e.g., Ve1 and Ve2) define a display area of one pixel.

In other words, intersection areas where the gate electrode line (e.g., Vg1) crosses two anode electrode strips 27 for green light emission (e.g., a11 and a12), one anode electrode 27' for red light emission (e.g., a21) and one anode electrode strip 27' for blue light emission (e.g., a22) define a display area of one pixel.

Accordingly, one pixel is defined by four color areas consisting of two green areas, one red area and one blue area. Pixels having such construction are arranged in a matrix configuration to constitute the display panel.

There will next be described a driving method of a fluorescent display device in accordance with the present invention.

Figure 3:
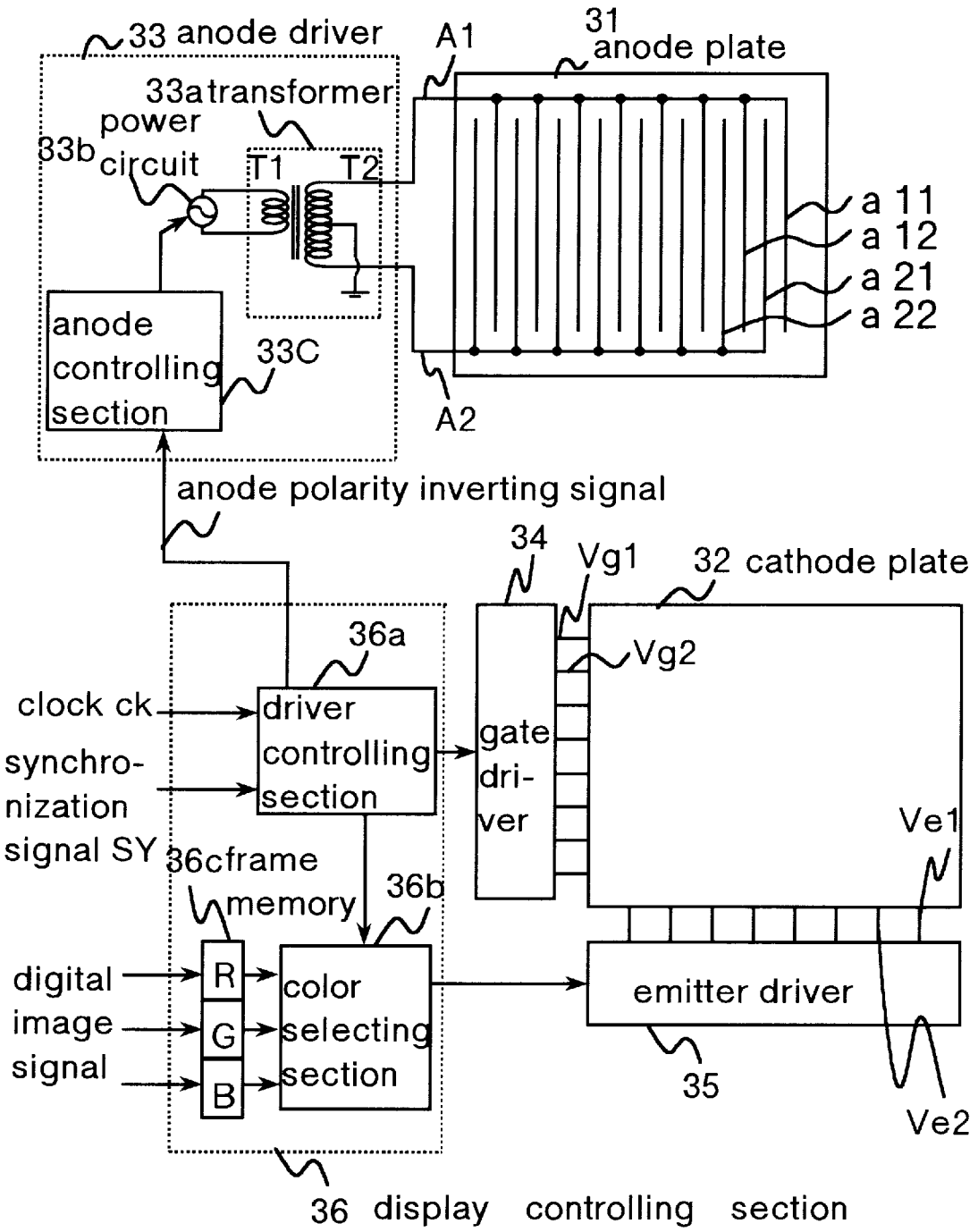
FIG. 3 is a block diagram of a driving circuit in accordance with one embodiment of the present invention.

FIG. 3 is a block diagram of a driving circuit of the fluorescent display device of the present invention. In FIG. 3, an anode plate 31 corresponds to the anode plate 21 shown in FIG. 2, and two anode electrodes A1 and A2 are arranged as shown.

A cathode plate 32 corresponds to the cathode plate 22 shown in FIG. 2. Emitter electrode lines Ve1, Ve2, . . . are controlled and driven by an emitter driver 35, and gate electrode lines Vg1, Vg2, . . . are controlled and driven by a gate driver 34.

An anode driver 33 includes a step-up transformer 33*a*, a power circuit 33*b* and an anode controller section 33*c* for controlling the step-up transformer 33*a* and power circuit 33*b* to apply voltages to the anode electrodes A1 and A2.

The anode electrodes A1 and A2 are connected to the secondary coil side T2 of the step-up transformer 33*a*, and voltages of opposite polarities are applied to the respective anode electrodes A1 and A2.

A display controlling section 36 includes a driver controlling section 36*a*, a color selecting section 36*b* and a frame memory 36*c*, and controls the positions of pixels to be actuated for color light emission based on an input image signal.

The driver controlling section 36*a* controls the anode driver 33, gate driver 34 and color selecting section 36*b*, based on an external input clock CK and synchronization signal SY for synchronizing input image data therewith.

The color selecting section 36*b* selects emitter electrode lines to be actuated for required color light emission (emission of lights of the three primary colors) based on input digital image signals (R, G or B).

The frame memory 36*c* is a memory for storing therein on a color basis the input digital image signals (R, G or B) required for one frame representation.

The driver controlling section 36*a* supplies anode polarity inverting signals to the anode controlling section 33*c*. The anode polarity inverting signals serve to periodically alternate the polarities of the voltages respectively applied to the anode electrodes A1 and A2.

The anode controlling section 33*c* outputs driving pulse signals for driving the power circuit 33*b* in synchronization with anode polarity inverting signals.

The power circuit 33*b* generates AC pulse voltages in correspondence with the anode polarity inverting signals, which AC pulse voltages are boosted by the step-up transformer 33*a* and then applied to the anode electrodes A1 and A2.

The voltages applied to the anode electrodes A1 and A2 are, for example, about ±400 V. When a voltage of +400 V is applied to the anode electrode A1, a voltage of −400 V is applied to the anode electrode A2, and vice versa.

One frame for displaying one pixel comprises two fields, i.e., green-displaying field and red-and-blue-displaying field. During the period of green-displaying field a positive voltage is applied to the anode electrode A1, and during the period of red-and-blue-displaying field a positive voltage is applied to the anode electrode A2.

Within a context of displaying one pixel, two green-light emitting areas, e.g., intersection areas where a gate electrode line Vg1 crosses anode electrode strips a11 and a12 above the corresponding emitter electrode lines as shown in FIG. 2, are activated for light emission during the period of green-displaying field, and red-light-emitting area and blue-light-emitting area, e.g., intersection areas where the gate electrode line Vg1 crosses anode electrodes strips a21 and a22 above the corresponding emitter electrode lines as shown in FIG. 2, are activated for light emission during the period of red-and-green-displaying field.

The driver controlling section 36*a* successively supplies address signals to the gate driver 34 in a cycle for selecting positions of pixels to be actuated for color light emission on the cathode plate 32. The gate driver 34 selects a gate electrode line designated by an address signal, and applies thereto a voltage (Vgh=50 V) higher than that (e.g., 20 V) to be applied to the other gate electrode lines not selected.

For example, the gate driver 34 selectively applies a voltage Vgh to the gate electrode line Vg1 for a predetermined time period, then applies the voltage Vgh to a gate electrode line Vg2 for the predetermined time period, and successively applies the voltage Vgh to gate electrode lines Vg3, Vg4, . . . for the predetermined time period.

To the other gate electrode lines not selected is applied a voltage that prevents electron emission from the emitter tips.

In synchronization with the driving of the gate driver 34, the driver controlling section 36*a* actuates the color selecting section 36*b* and successively reads out the color data stored in the frame memory 36*c*. The color selecting section 36*b* supplies a signal for selecting an emitter electrode line according to the read-out color data.

The emitter driver 35 applies a negative voltage to the emitter electrode line designated by the supplied signal for electron emission. At this time, a voltage is applied to the emitter electrode line during a period in which the pixel to be actuated for color light emission is continuously selected by the gate electrode line.

That is, electrons are emitted by the emitter tips located in an intersection area where a gate electrode line under a high voltage (Vgh) crosses an emitter electrode line under negative voltage to actuate the pixel formed in the intersection area for color light emission.

Figure 4:
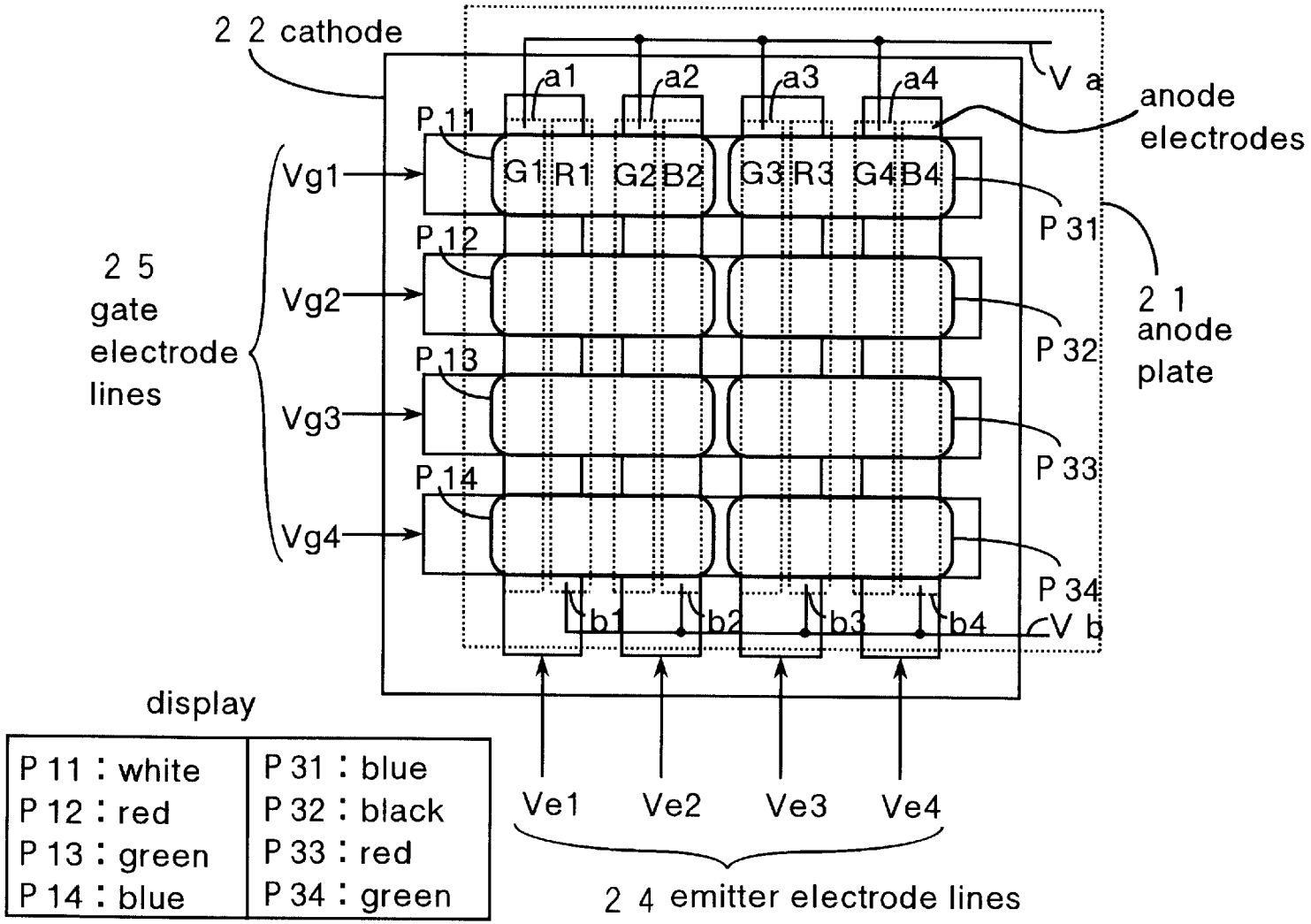
FIG. 4 is a plan view of a fluorescent display device comprising 2×4 pixels in accordance with one embodiment of the present invention.
Figure 5:
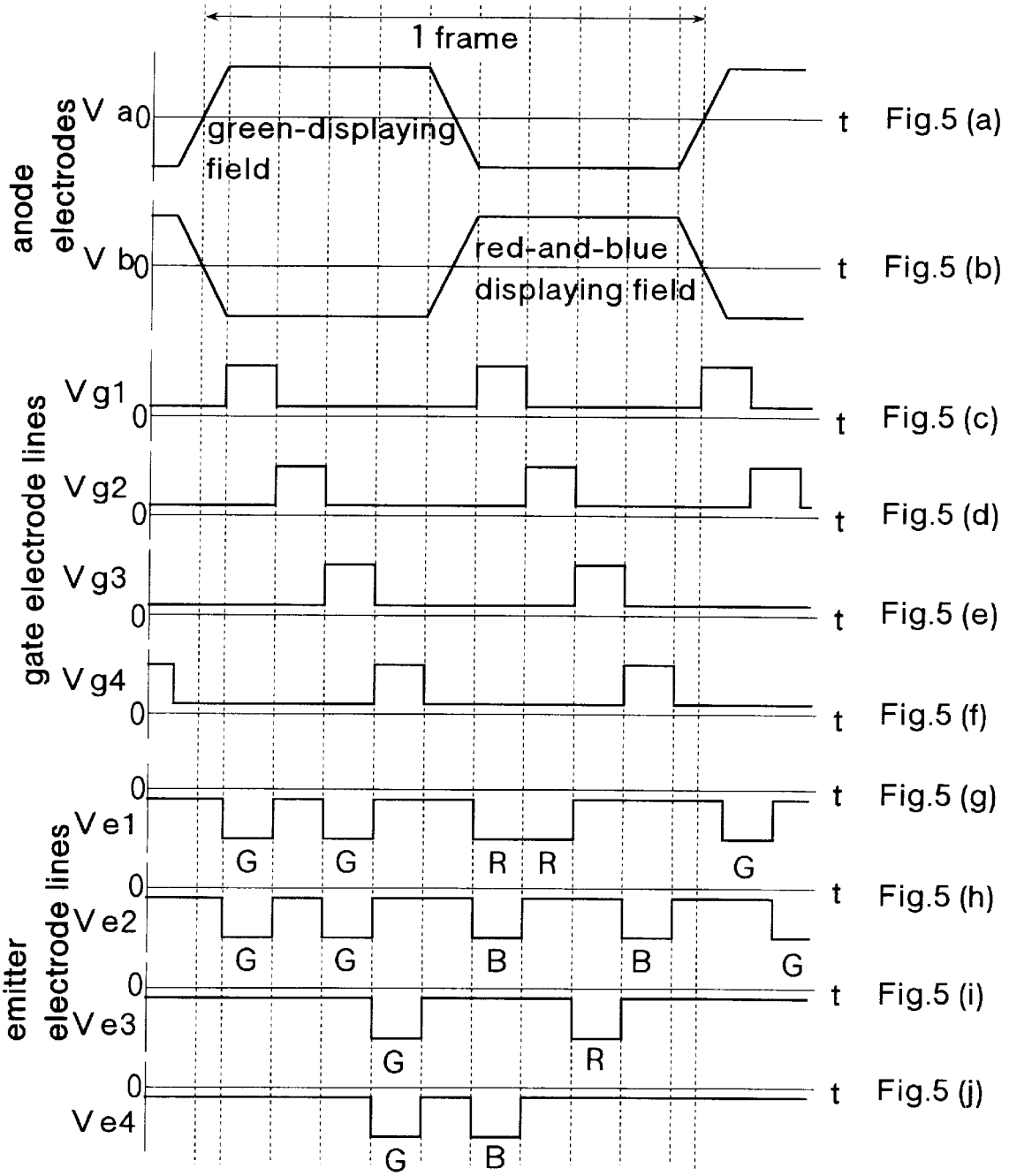
FIGS. 5(*a*)–5(*j*) are timing charts for driving signals in accordance with the embodiment shown in FIG. 4.

With reference to FIGS. 4 and 5, wave forms of driving pulses employed for the driving circuit of the present invention will next be described by way of an embodiment.

FIG. 4 is a plan view of a fluorescent display device of a 2×4 pixel matrix. As shown, anode electrodes Va and Vb are disposed on an anode plate 21, and each one connected to a secondary coil side of a step-up transformer at one end thereof.

The anode electrodes Va and Vb are formed into comb-shaped patterns, and have four electrode strips a1, a2, a3 and a4 and four electrode strips b1, b2, b3 and b4, respectively. The electrode strips a1, a2, a3 and a4 are arranged in alternate relation with the electrode strips b1, b2, b3 and b4. The electrode strips a1, a2, a3 and a4 of the anode electrode Va are coated with a green fluorescent substance. The electrode strips b1 and b3 are coated with a red fluorescent substance, and the electrode strips b2 and b4 are coated with a blue fluorescent substance.

In FIG. 4, four emitter electrode lines 24 (Ve1, Ve2, Ve3 and Ve4) and four gate electrode lines 25 (Vg1, Vg2, Vg3 and Vg4) are disposed on a cathode plate 22. Emitter tips (not shown) are disposed in intersection areas where the emitter electrode lines 24 cross perpendicular to gate electrode lines 25.

The emitter electrode lines 24 are arranged parallel to the anode electrode strips a1 to a4 and b1 to b4 in such a manner that one emitter electrode line 24 generally overlaps two adjacent anode electrode strips as viewed from the top in FIG. 4. For example, the emitter electrode line Ve1 is arranged so as to overlap the anode electrode strips a1 and b1.

In the fluorescent display device thus prepared in accordance with this embodiment, there exist eight pixels P11 to P14 and P31 to P34 each having four color-light-emitting areas. For example, the left upper pixel P11 shown in FIG. 4 has a green-light-emitting area G1, a red-light-emitting area R1, a green-light-emitting area G2 and a blue-light-emitting area B2, and the right upper pixel P31 has a green-light-emitting area G3, a red-light-emitting area R3, a green-light-emitting area G4 and a blue-light-emitting area B4.

The darkness and brightness of the four color-light-emitting areas in each pixel determine what color the pixel exhibits. Whether or not a particular color-light-emitting area emits light is determined by voltages applied respectively to the anode electrodes. Va and Vb, voltages applied to the emitter electrode lines 24, and voltages applied to the gate electrode lines 25.

For the pixel P11, it is assumed that a predetermined negative voltage is applied to the emitter electrode lines Ve1 and Ve2 and a predetermined voltage for electron emission is applied to the gate electrode line Vg1 while a predetermined positive voltage is applied to the anode electrode Va. In such case, electrons emitted from the emitter electrode lines Ve1 and Ve2 are attracted by the green-light-emitting areas G1 and G2 in the pixel P11, and the pixel P11 emits green light.

At this time, since a voltage having a polarity opposite to that applied to the anode electrode Va, i.e., a negative voltage is applied to the anode electrode Vb, the red-light-emitting area R1 and blue-light-emitting area B2 do not emit light.

On the contrary, if a predetermined positive voltage is applied to the anode electrode Vb and a voltage having a polarity opposite to that applied to the anode electrode Vb, i.e., a negative voltage is applied to the anode electrode Va, the red-light-emitting area R1 and the blue-light-emitting area B2 emit their respective color lights in the, pixel P11.

FIGS. 5(*a*)–5(*j*) are timing charts for driving signals for the fluorescent display device of a 2×4 pixel matrix shown in FIG. 4.

The driving pulses shown in FIGS. 5(*a*)–5(*j*) are employed when pixels P11, P12, P13 and P14 in the left column and pixels P31, P32, P33 and P34 in the right column shown in the plan view of FIG. 4 exhibit white, red, green, blue, blue, black, red and green, respectively.

In FIGS. 5(*a*)and 5(*b*), the two wave forms represent voltages applied respectively to the anode electrodes Va and Vb, the four wave forms shown in FIGS. 5(*g*)–5(*j*) represent voltages applied respectively to the gate electrode lines Vg1 to Vg4, and the four wave forms shown in FIGS. 5(*g*)–5(*j*) represent voltages applied respectively to the emitter electrode lines Ve1 to Ve4.

As previously mentioned, one frame for displaying one pixel comprises a green-displaying field and red-and-blue-displaying field. In the green-displaying field, a positive voltage is applied to the anode electrode Va, and a negative voltage is applied to the anode electrode Vb at the same time. In the red-and-blue displaying field, a negative voltage is applied to the anode electrode Va, and a positive voltage is applied to the anode electrode Vb at the same time.

When one of two adjacent anode electrode strips emits light, the light emission from the other can be prevented by thus driving the respective anode electrodes Va and Vb.

As shown in FIG. 5, the gate electrode lines are scanned with predetermined time intervals in the respective fields. That is, a voltage (e.g., 50 V) that can attract electrons from emitters is successively applied to the gate electrode lines Vg1, Vg2, Vg3 and Vg4 in this order. At this time, the gate driver 34 selects a gate electrode line for voltage application thereto, based on an address signal input from the driver controlling section 36*a*.

In the green-displaying field shown in FIG. 5, when a predetermined voltage is applied to the gate electrode line Vg1, a negative voltage for electron emission is applied to the emitter electrode lines Ve1 and Ve2. When a predetermined voltage is applied to the gate electrode line Vg3, a negative voltage is applied again to the emitter electrode lines Ve1 and Ve2. Further, when a predetermined voltage is applied to the gate electrode Vg4, a negative voltage is applied to the emitter electrode lines Ve3 and Ve4. That is, the green-light-emitting areas in the pixels P11, P13 and P34 emit green light in the green-displaying field.

For red light emission in the red-and-blue-displaying field, a negative voltage is applied to the emitter electrode line Ve1 at the time of voltage application to the gate electrode line Vg1 and at the time of voltage application to the gate electrode line Vg2, and applied to the emitter electrode line Ve3 at the time of voltage application to the gate electrode line Vg3.

For blue light emission in the red-and-blue-displaying field, a negative voltage is applied to the emitter electrode lines Ve2 and Ve4 at the time of voltage application to the gate electrode line Vg1, and applied to the emitter electrode line Ve2 at the time of voltage application to the gate electrode line Vg4.

That is, in the red-and-blue-displaying field, the red-light-emitting area in the pixel P11 and the blue-light-emitting areas in the pixels P11 and P31 first emit their respective color lights at the time of voltage application to the gate electrode line Vg1, then the red-light-emitting area in the pixel P12 emits red light at the time of voltage application to the gate electrode line Vg2, then the red-light-emitting area in the pixel P33 emits red light at the time of voltage application to the gate electrode line Vg3, and the blue-light-emitting area in the pixel P14 emits blue light at the time of voltage application to the gate electrode line Vg4.

In the pixel P11, therefore, the green-light-emitting areas G1 and G2, red-light-emitting area R1 and blue-light-emitting area B2 all emit their respective color lights in one frame, so that the pixel P11 exhibits white.

In the pixels P12 and P32, only the red-light-emitting areas emit red light in one frame, so that the pixels P12 and P32 exhibit red. Similarly, the pixels P13 and P34, in which the green-light-emitting areas emit green light, exhibit green. The pixels P14 and P31, in which the blue-light-emitting areas emit blue light, exhibit blue. The pixel P33 exhibits black, because none of the color-light-emitting areas emit light.

In accordance with this embodiment, when a positive voltage is applied to one of two adjacent anode electrode strips (e.g. a1) disposed above one emitter electrode line 24 (e.g., Ve1), a negative voltage is applied to the other anode electrode strip (e.g., b1).

Therefore, the anode electrode strip a1 under positive voltage application attracts electrons emitted from emitters, while the electrons do not reach the anode electrode strip b1 under negative voltage application.

Thus, the electron beams to be led to two non-adjacent color-light-emitting areas in a pixel can be prevented from flaring to neighboring color-light-emitting areas and, hence, color blurring can be prevented.

Though the foregoing embodiments employ the combination of two green-light-emitting areas, one red-light-emitting area and one blue-light-emitting area to constitute each pixel, any other color combination can be employed. With the color combination employed in the foregoing embodiments, the green fluorescent substance can receive an electron current twice as much as that to be received by the fluorescent substances of the other colors and, therefore, a fluorescent substance having a lower light-emitting efficiency can be effectively utilized.

Figure 6:
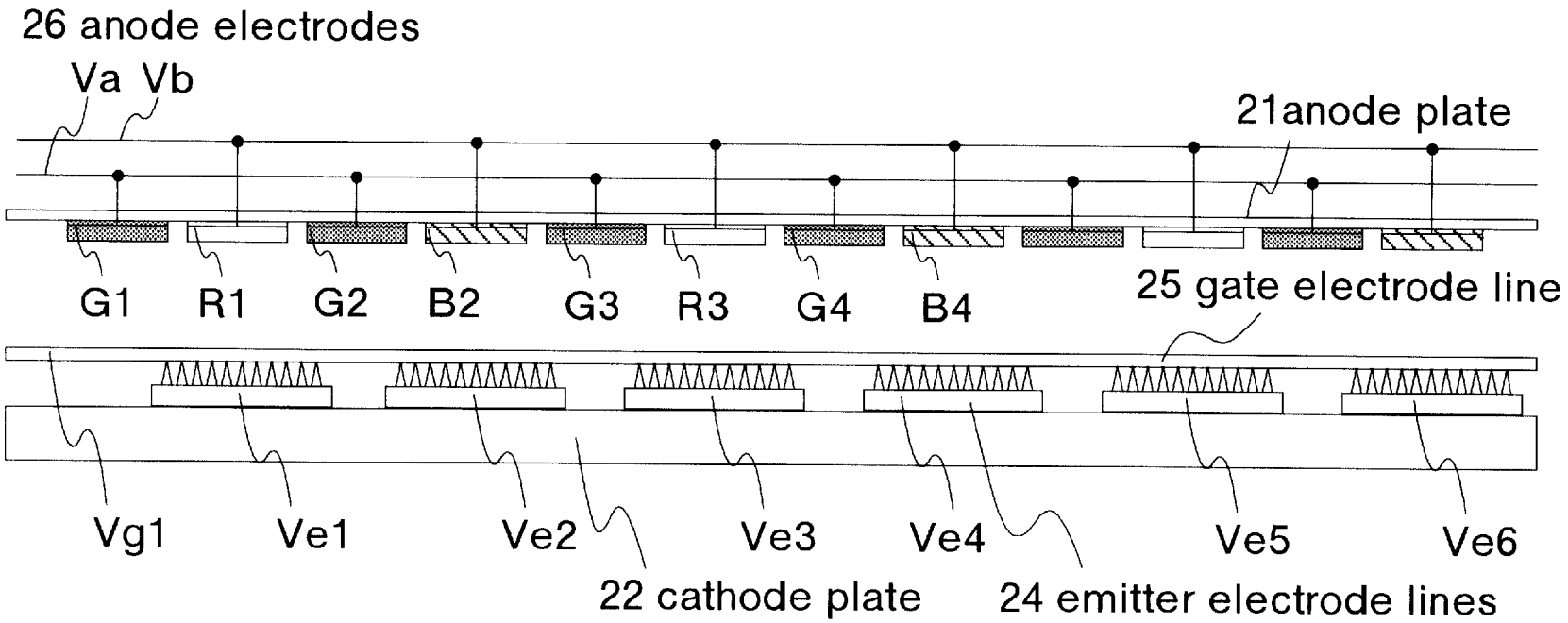
FIGS. 6, 7 and 8 are sectional views of a fluorescent display device in accordance with another embodiment of the present invention.

FIG. 6 is a sectional view of a fluorescent display device of the present invention, in which emitter electrode lines are disposed just below anode electrode strips for red light emission and for blue light emission. In FIG. 6, there are shown emitter electrode lines 24 (Ve1 to Ve6) extending perpendicular to the plane of this drawing, gate electrode line 25 (Vg1), anode electrode Va having green-light-emitting strips G1, G2, . . . coated with a green fluorescent substance, and anode electrode Vb having red-light-emitting strips R1, R3, . . . coated with a red fluorescent substance and blue-light-emitting strips B2, B4, . . . coated with a blue fluorescent substance.

Figure 7:
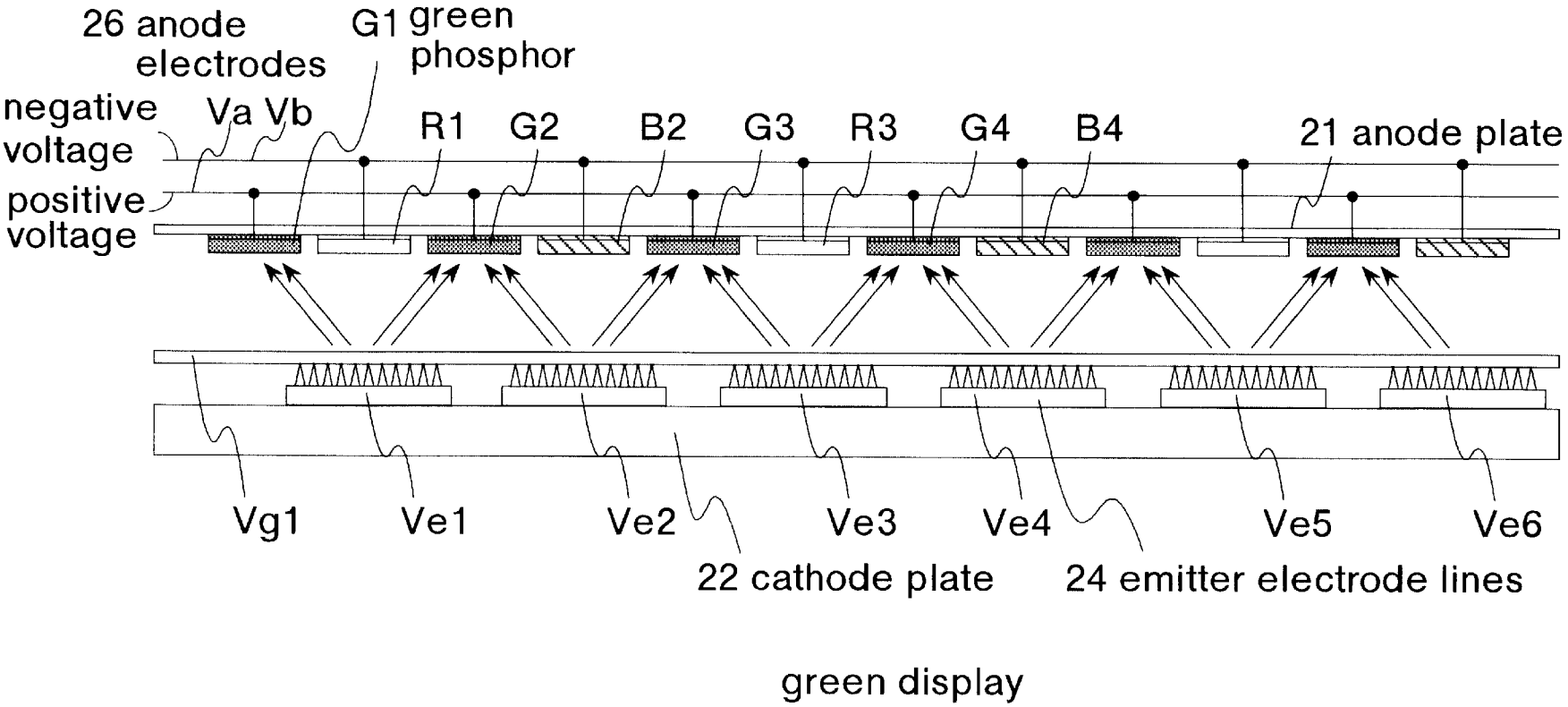

FIG. 7 is a schematic view of the fluorescent display device having the structure shown in FIG. 6 for illustrating the direction of electron beam emission when green light is emitted. In this case, a positive voltage (e.g., +200 V) is applied to the anode electrode Va and a negative voltage (e.g., −200 V) is applied to the anode electrode Vb, while a negative voltage (e.g., −30 V) is applied to all the emitter electrode lines 24 and a voltage (e.g., +50 V) for electron emission is applied to the gate electrode line Vg1.

Thus, electrons emitted from emitter tips are attracted to the green-light-emitting strips G1, G2, . . . under positive voltage application, and are repelled by the red- and blue-light-emitting strips R1, B2, R3, B4, . . . under negative voltage application. This construction can effectively prevent red- and blue-light emission and produces the green-light emission free from color blurring.

Figure 8:
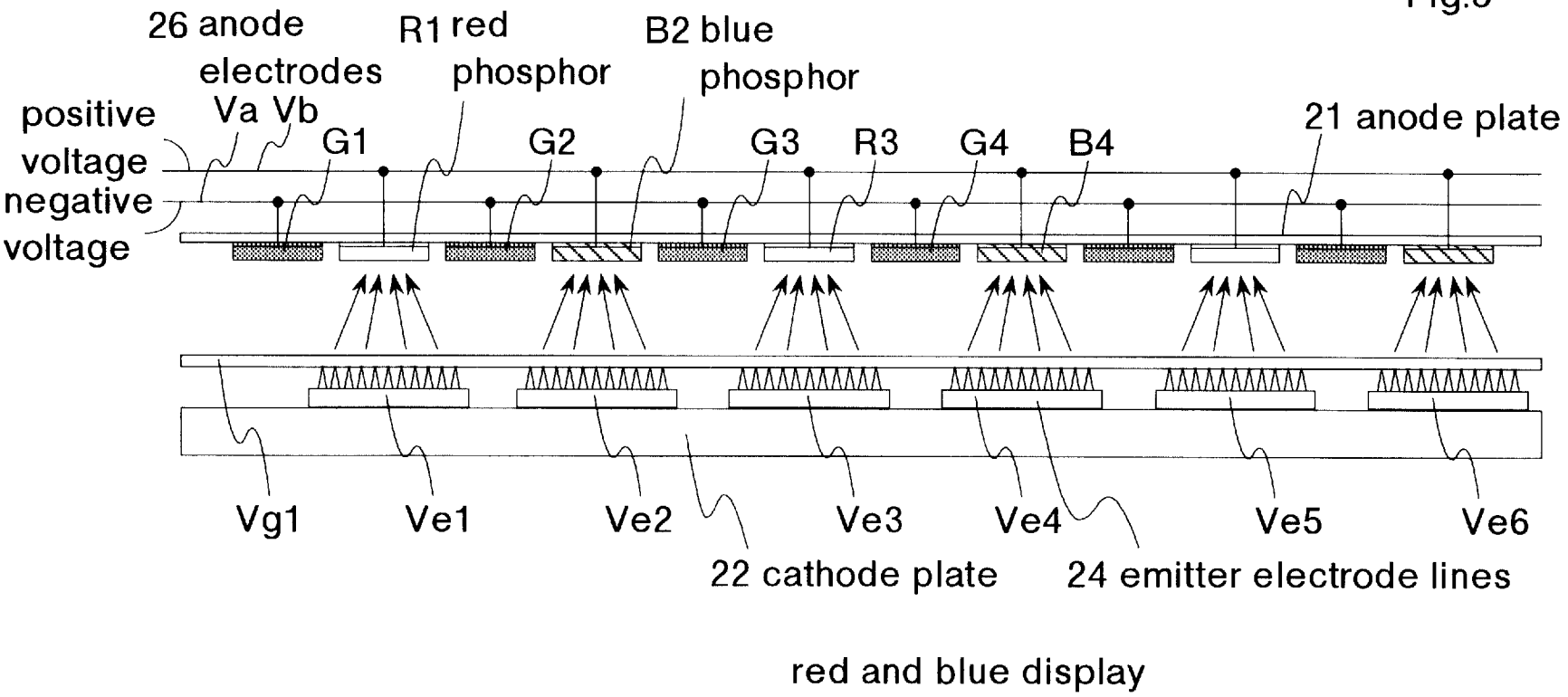

FIG. 8 is a schematic view of the fluorescent display device for illustrating the direction of electron beam emission when the red- and blue-light-emitting strips of the anode electrode emit their respective color lights. In this case, a negative voltage is applied to the anode electrode Va and a positive voltage is applied to the anode electrode Vb opposite to the case shown in FIG. 7. At the same time, voltages the same as those shown in FIG. 7 are respectively applied to all the emitter electrode lines 24 and gate electrode line Vg1.

Thus, electrons emitted from emitter tips are attracted to the red-light-emitting strips R1, R3, . . . and the blue-light-emitting strips B2, B4, . . . under positive voltage application, and are repelled by the green-light-emitting strips G1, G2, . . . under negative voltage application.

Therefore, red- and blue-light-emitting strips can emit their respective color lights without influencing the neighboring green-light-emitting strips. In addition, since the negative voltage is applied to the green-light-emitting strips, electrons emitted for red-light emission do not go beyond the neighboring green-light-emitting strips to reach the next neighboring blue-light-emitting strips, and hence flaring of the electron beam can be prevented. Thus, color light emission free from color blurring can be produced.

In either of the cases where the emitter electrode lines are each disposed below two adjacent color-light-emitting strips, i.e., one green-light-emitting strip and one red-light-emitting strip or one blue-light-emitting strip as shown in FIG. 4 and where the emitter electrode lines are disposed just below red- and blue-light-emitting strips, light emission free from color blurring can be produced. Even if the emitter electrode lines are displaced with respect to the anode electrode strips by an amount equal to the spacing between two adjacent anode electrode strips (about 100 $\mu$m), no color blurring occurs. Therefore, there is no need to precisely align the emitter electrode lines with the anode electrode strips unlike the conventional cases, and these structures are advantageous in terms of the fabrication of fluorescent display devices.

In accordance with the present invention, since the anode unit comprises two anode electrodes formed into comb-shaped patterns, the crossing of wiring can be eliminated, unlike the conventional case where three anode conductive film electrodes are electrically connected with each other. The construction of the circuit pattern on the anode side is thus simple and, therefore, the production process can be simplified.

Further, since voltages of opposite polarities are simultaneously applied respectively to the two anode electrodes, a step-up transformer can be employed instead of expensive high-voltage-resistant switching elements. Therefore, the anode electrodes can be driven by an inexpensive and simple driving circuit.

Still further, the voltage resistance of the transformer can easily be enhanced and, therefore, the light emission efficiency of the fluorescent substances can easily be increased by raising the voltage to be applied to the anode electrodes.

Though the color-light-emitting areas of the anode electrodes are switched every half frame period in the case shown in FIG. 5, the switching may be carried out on every scanning of the gate electrode lines. In this case, the color switching cycle is shortened, whereby the residual single-color image observed when the view angle is changed can be suppressed.

Figure 9:
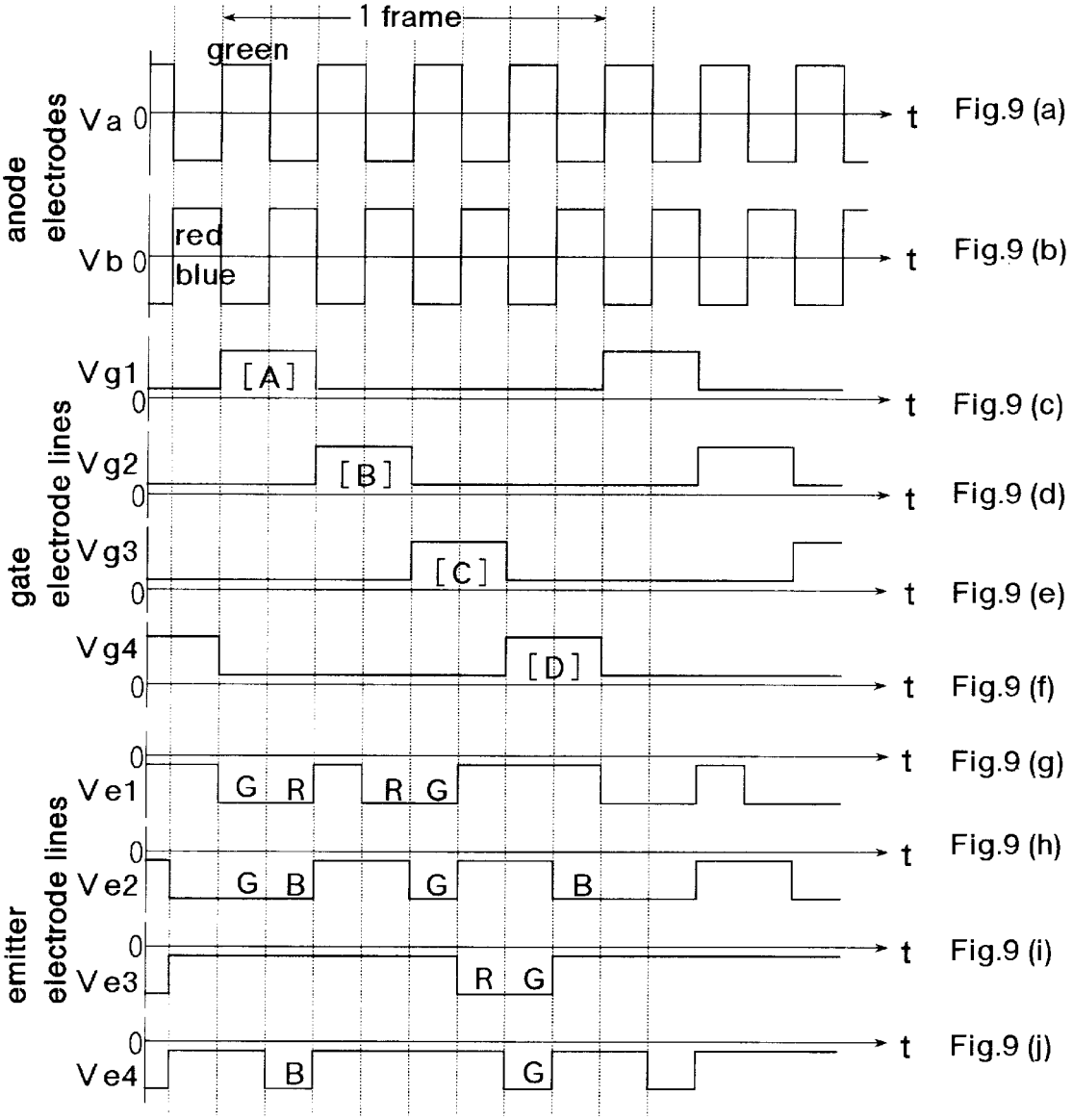
FIGS. 9(*a*)–9(*j*) are timing charts of driving signals to be employed where the polarities of voltages applied to anode electrodes are switched every scanning of gate electrode lines, in accordance with the embodiment shown in FIG. 4.

FIGS. 9(*a*)–9(*j*) are timing charts of driving signals to be employed where the light-emitting areas of the anode electrodes are switched on every scanning of the gate electrode lines. The arrangement of color-light-emitting areas is the same as that of the embodiment shown in FIGS. 5(*a*)–5(*j*). As shown, the inversion of the voltage polarities respectively applied to the anode electrodes occurs once in a time period during which one gate electrode line is actuated.

Within the context of displaying one frame, in a state [A] where a positive voltage is applied to a first gate electrode line Vg1, a driving voltage is applied to the anode electrode strips a1, a2, a3 and a4 during the first half of the period of the state [A] and, at the same time, driving voltages as shown in FIGS. 9(*a*)–9(*j*) are applied to the emitter electrode lines Ve1 to Ve4 to control the light emission of the green-light-emitting areas. During the second half of the period [A], a driving voltage is applied to the anode electrode strips b1, b2, b3, and b4 and, at the same time, driving voltages as shown in FIG. 9 are applied to the emitter electrode lines Ve1 to Ve4 to control the light emission of the red- and blue-light-emitting areas. Accordingly, pixels P11 and P31 exhibit white and blue, respectively, in the state [A].

Similarly, in a state [B] where a positive voltage is applied to the next gate electrode line Vg2, the pixels P12 and P32 exhibit red and black, respectively. Further, in a state [C] of driving the next gate electrode line Vg3, pixels P13 and P33 exhibit green and red, respectively, and in a state [D] of driving the next gate electrode line Vg4, pixels P14 and P34 exhibit blue and green, respectively.

Thus, the operation of switching the voltage polarities applied to the respective anode electrodes is performed four times in one frame to actuate eight pixels for color light emission. The switching interval between respective color light emissions is so short that the residual color image can be advantageously rendered unnoticeable.

Further, since image data retained in one gate electrode line can be output at a time, a memory capable of storing data for one gate electrode line is employed instead of a large capacity memory such as frame memory.

Though the foregoing embodiments are directed to color fluorescent display devices, the present invention can also be applied to monochromic display devices.

Figure 10:
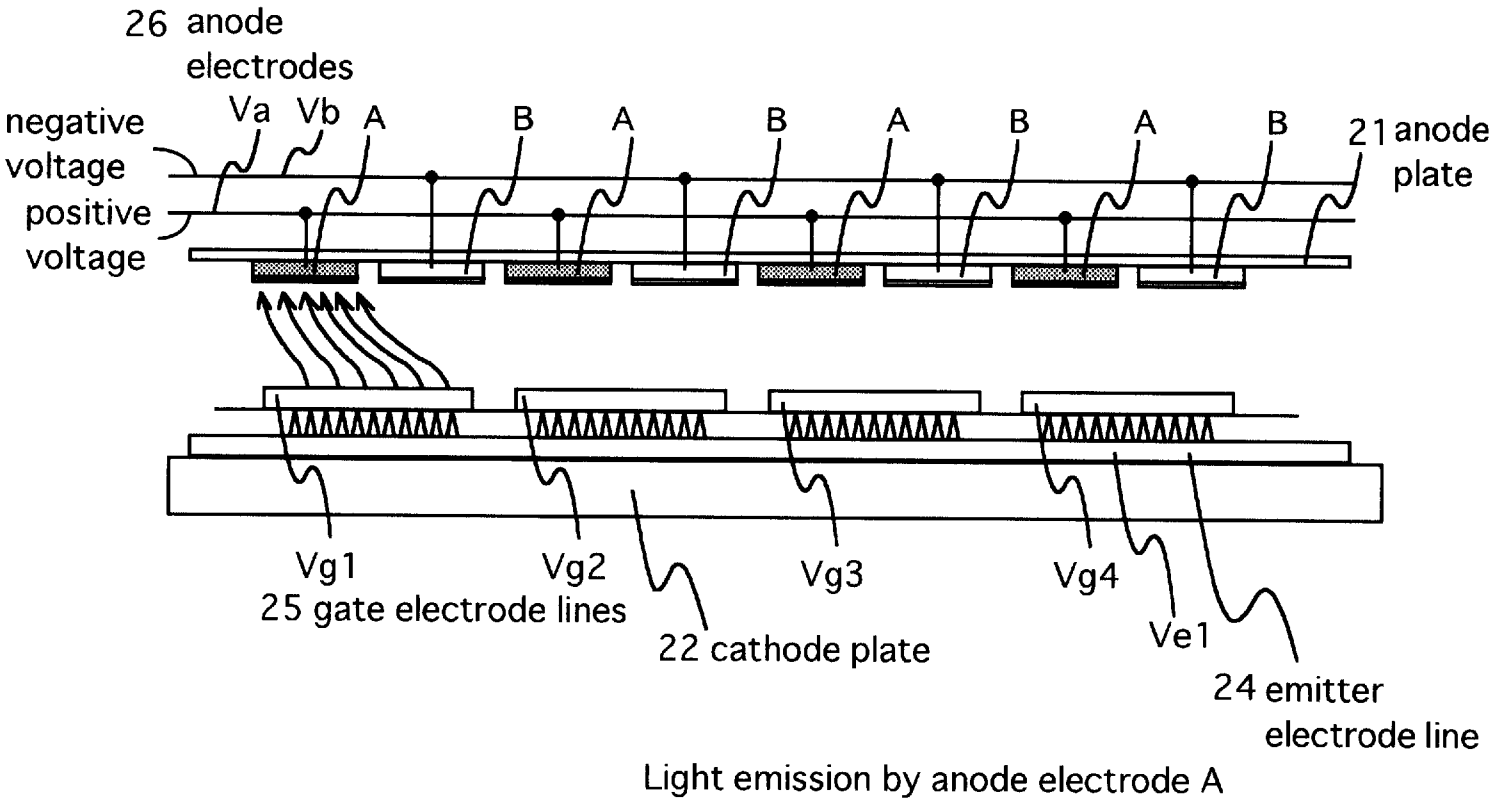
FIGS. 10 and 11 are sectional views of a fluorescent display device for monochromic display in accordance with still another embodiment of the present invention.
Figure 11:
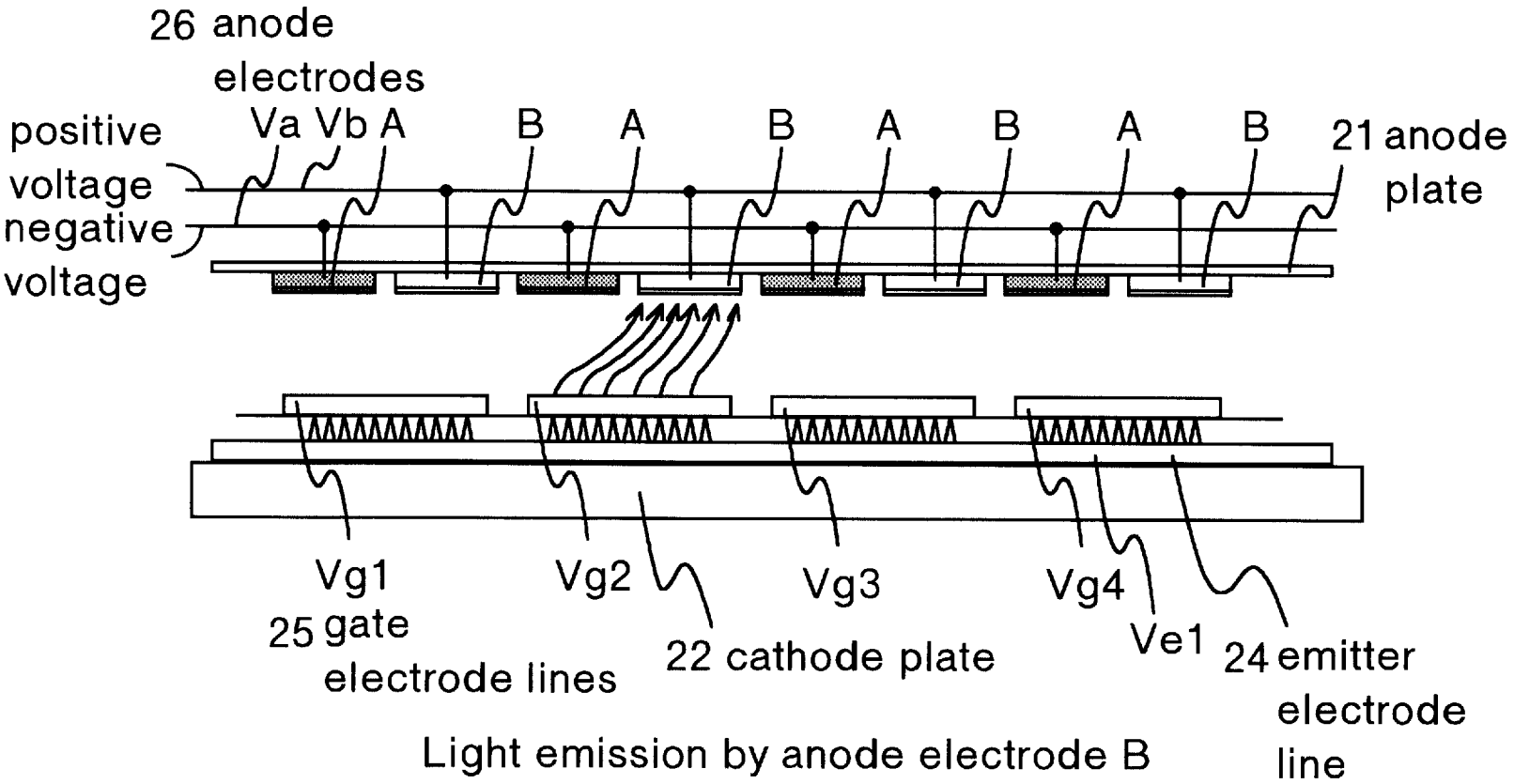
Figures 12A, 12B:
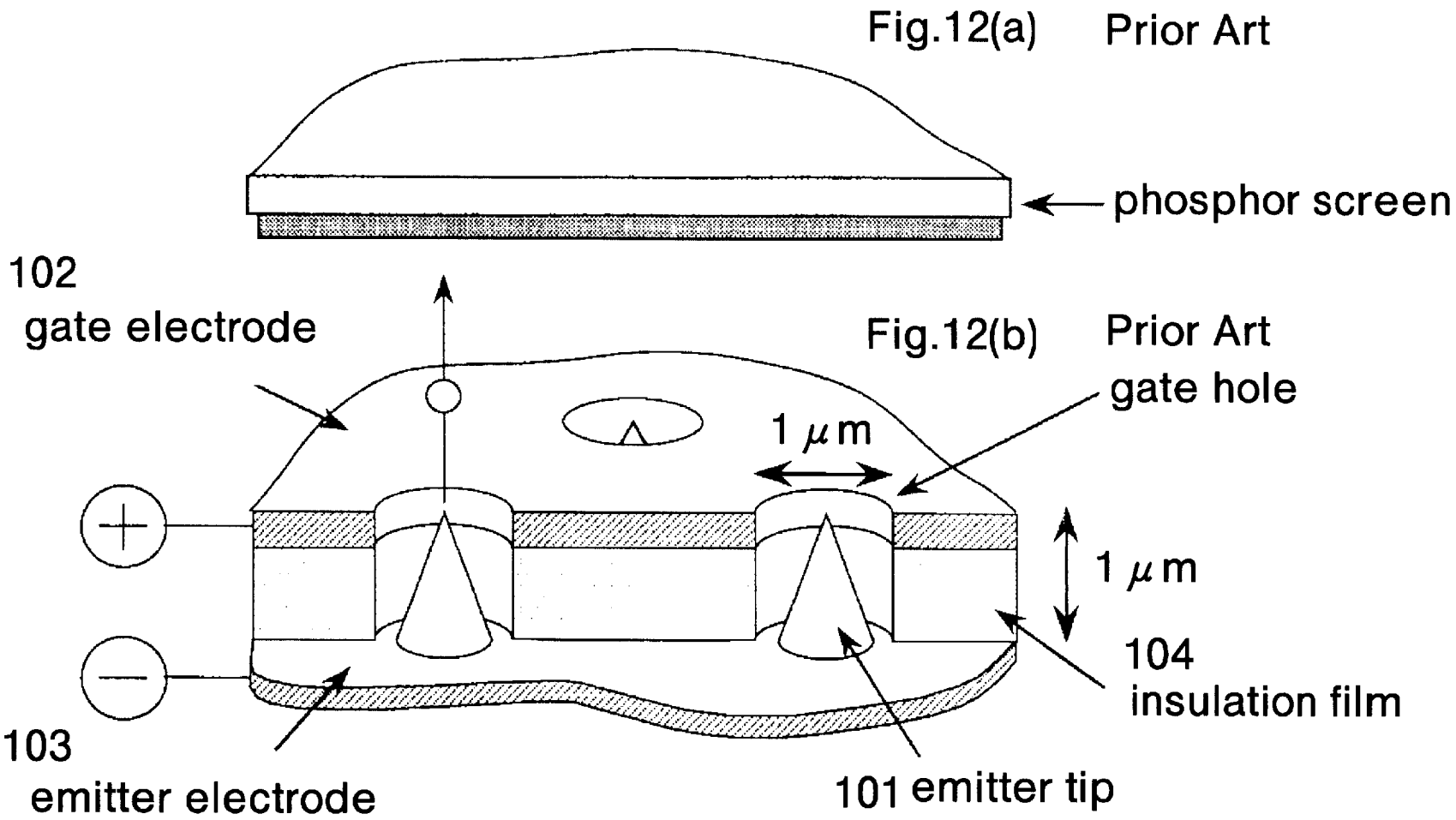
Fig.12(a) Prior Art
Fig.12(b) Prior Art
FIGS. 12(*a*) and 12(*b*) are perspective views of a conventional field emission cathode for explaining the construction thereof.
Figure 13:
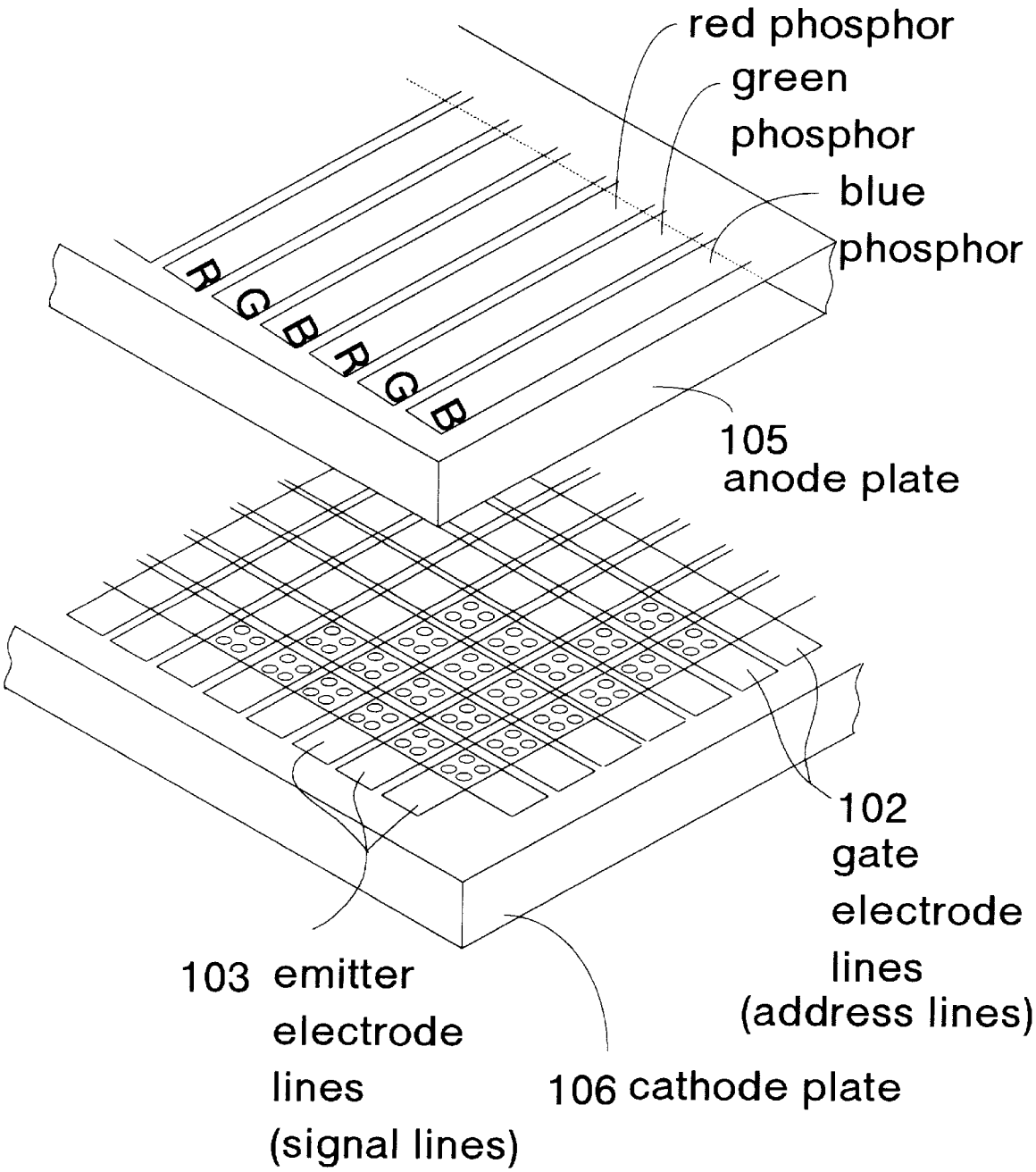
Fig.13 Prior Art
FIG. 13 is a perspective view illustrating the structure of a conventional flat panel display.
Figure 14:
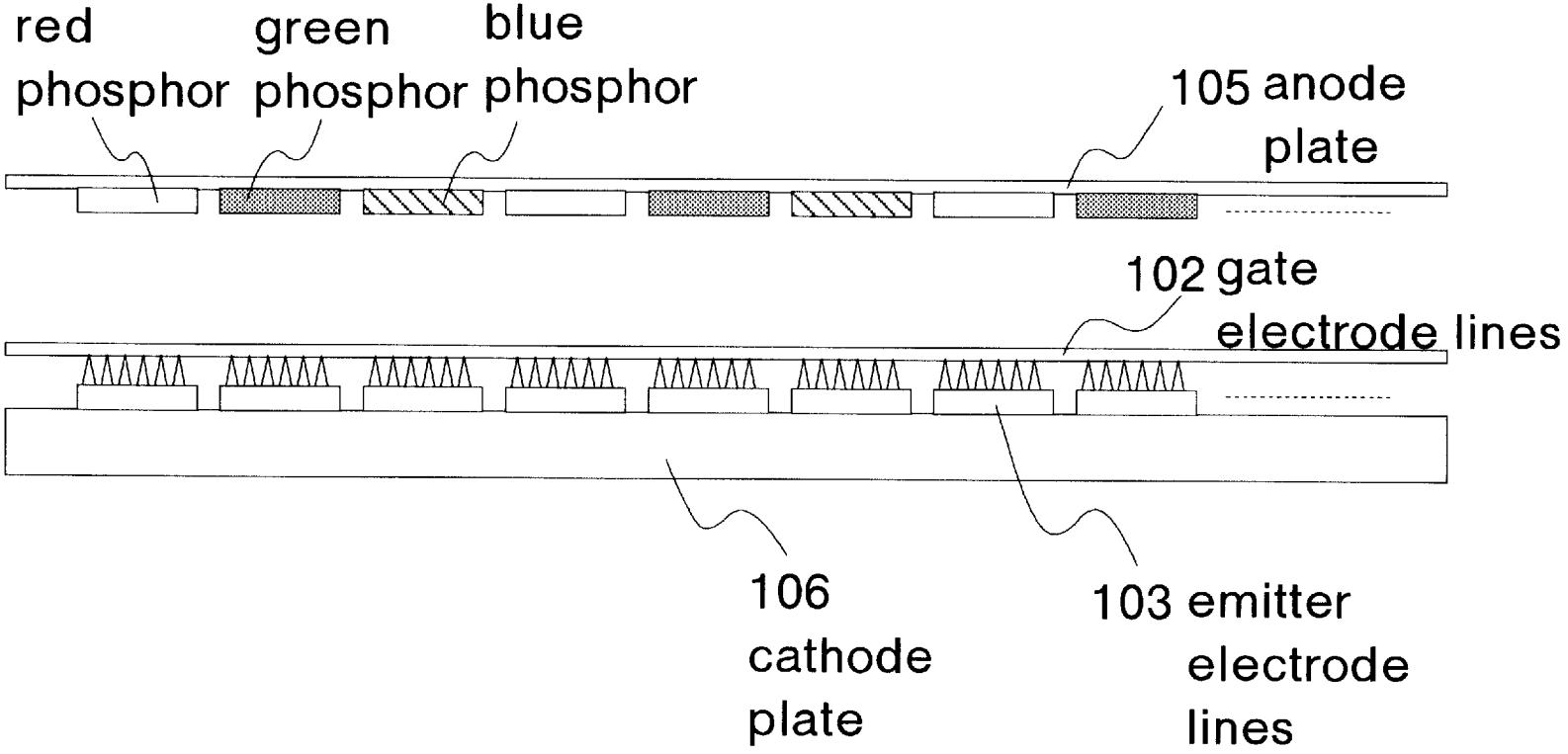
Fig.14 Prior Art
FIGS. 14 and 15 are sectional views of another conventional flat panel display.
Figure 15:
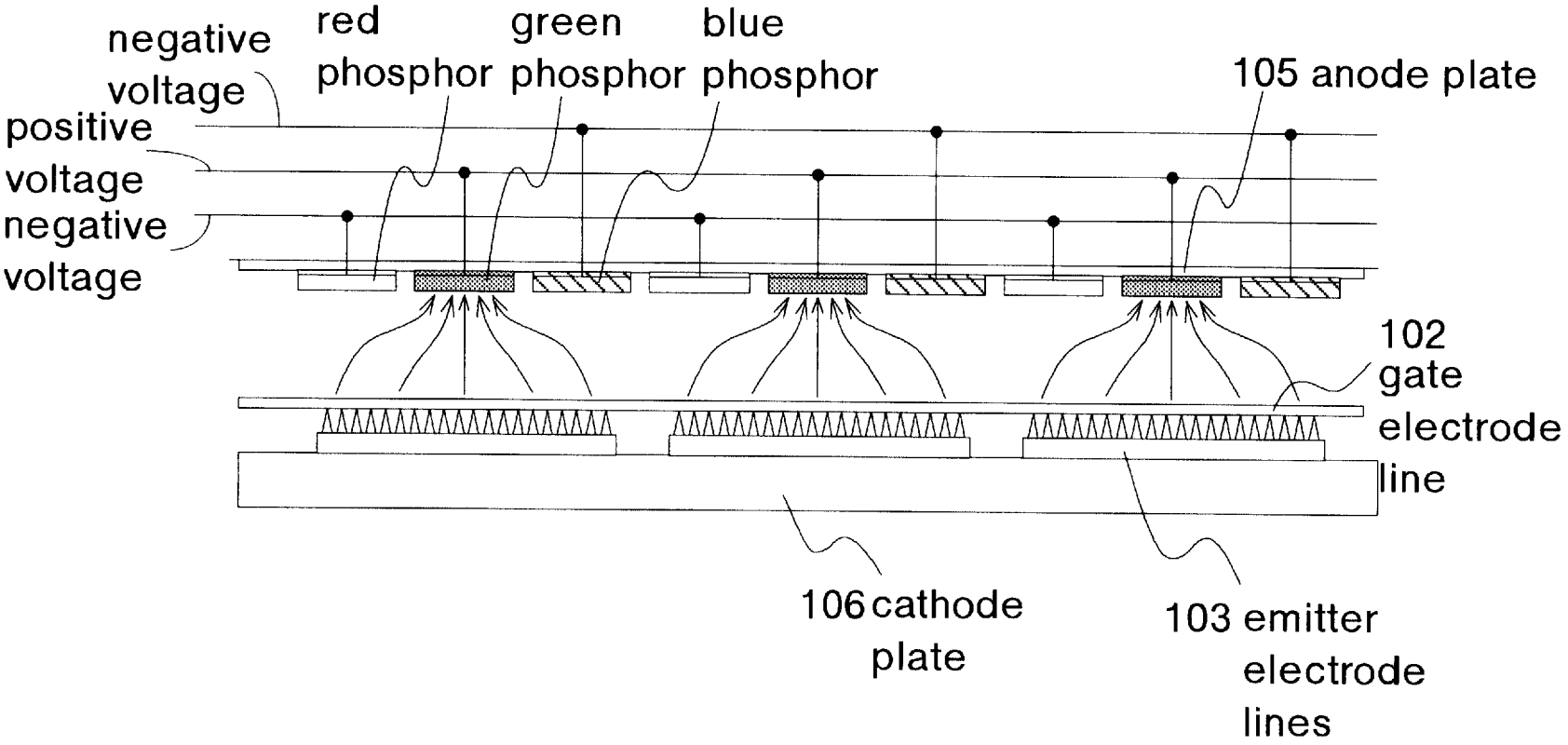
Fig.15 Prior Art

FIGS. 10 and 11 are sectional views of a monochromic display device to which the present invention is applied.

In this embodiment, gate electrode lines are disposed parallel to anode electrode strips, unlike the embodiments shown in FIGS. 4 and 6. That is, the gate electrode lines and anode electrode strips extend perpendicular to the plane of the drawing, while emitter electrode lines extend parallel to the plane of the drawing.

Similar to the embodiments shown in FIGS. 4 and 6, the anode includes two anode electrodes A and B formed into comb-shaped patterns and respectively having a plurality of anode electrode strips coated with a fluorescent substance. The anode electrode strips of the anode electrodes A are arranged in alternate relation with those of the anode electrode B.

Voltages of opposite polarities are simultaneously applied to the respective anode electrodes A and B, and alternated in the same manner as in the embodiment shown in FIG. 4. As shown in FIG. 10, when positive and negative voltages are applied to the anode electrode A and B, respectively, voltages allowing the emitter tips to emit electrons are successively applied to the gate electrode lines, and only the fluorescence-coated areas on the electrode strips of the anode electrode A emit light in succession.

As shown in FIG. 11, when positive and negative voltages are applied to the anode electrode B and A, respectively, voltages allowing the emitter tips to emit electrons are successively applied to the gate electrode lines, and only the fluorescence-coated areas on the electrode strips of the anode electrode B emit light in succession.

By employing such configuration, there is no need to change the structure of the cathode plate for the monochromic fluorescent display device, and the resolution of the monochromic fluorescent display can be double that of the foregoing color fluorescent displays.

In accordance with the present invention, the anode includes two groups of anode electrodes, which are arranged so that the anode electrodes of one group alternate with those of the other group, and voltages of opposite polarities are applied to the respective anode electrodes for the driving thereof. That is, voltages of opposite polarities are respectively applied to any two adjacent anode electrodes and, thus, color blurring can be prevented.

Further, the circuit pattern of the anode unit can be simplified by employing the device configurations and driving methods in accordance with the present invention. In addition, there is no need to precisely position the cathode unit with respect to the anode unit, thereby simplifying the production process.

What is claimed is:

1. A fluorescent display device comprising:

a cathode unit including a plurality of cathodes arranged in a matrix array;

an anode unit including first and second groups of anode electrodes disposed above said cathode unit, arranged parallel to each other and coated with a fluorescent substance, the anode electrode of each group being connected commonly to each other by wiring, the anode electrodes of one of the first and second groups being disposed as alternating with those of the other group;

a voltage applying means for applying voltages of opposite polarities respectively to the first and second groups of anode electrodes and alternating the polarities of the voltages; and a display controlling means for controlling electron emitting positions on the cathode unit and said voltage applying means.

2. A fluorescent display device as set forth in claim 1, wherein said plurality of cathodes include a plurality of emitter electrode lines each having a plurality of emitter tips, and a plurality of gate electrode lines formed perpendicular to said emitter electrode lines for attracting electrons emitted from the emitter tips, with an insulation film being interposed therebetween; and said emitter electrode lines extend parallel to the anode electrodes of said anode unit, and are disposed so that each of said emitter electrode lines corresponds in width to two adjacent anode electrodes of the anode unit; and said fluorescent substance includes a fluorescent substance of a first color, a fluorescent substance of a second color and a fluorescent substance of a third color, which respectively represent the three primary colors, and the anode electrodes of the anode unit are respectively coated with the fluorescent substance of the first color, the fluorescent substance of the second color and the fluorescent substance of the third color in a repeated color sequence of the first color, second color, first color and third color; and anode electrodes coated with the fluorescent substance of the first color constitute the first group of anode electrodes and are all interconnected so as to have an equal potential, while anode electrodes coated with the fluorescent substance of the second color and the fluorescent substance of the third color constitute the second group of anode electrodes and are all interconnected so as to have an equal potential.

3. A fluorescent display device as set forth in claim 2, wherein a plane including said anode unit is disposed opposite and parallel to a plane including said cathode unit, with the emitter electrode lines of the cathode being located generally just below the anode electrodes coated with the fluorescent substance of the second color and the fluorescent substance of the third color.

4. A fluorescent display device as set forth in claim 1, wherein said plurality of cathodes include a plurality of emitter electrode lines each having a plurality of emitter tips, and a plurality of gate electrode lines formed perpendicular to said emitter electrode lines for attracting electrons emitted from the emitter tips, with an insulation film being interposed therebetween; and said gate electrode lines extend parallel to the anode electrodes of the anode unit, and are disposed so that each of said gate electrode lines corresponds in width to two adjacent anode electrodes of the anode unit; and the anode electrodes of each of the first and second groups coated with the fluorescent substance are all interconnected so as to have an equal potential.

5. A fluorescent display device as set forth in claim 1, 2 or 4, wherein said voltage applying means comprises a transformer connected to the anode unit including the first and second groups of anode electrodes on the secondary coil side thereof so that voltages of opposite polarities are alternately applied respectively to the first and second groups of anode electrodes.

6. A method of driving a fluorescent display device comprising:

a cathode unit including a plurality of cathodes arranged in a matrix array;

an anode unit including first and second groups of anode electrodes disposed above said cathode unit, arranged parallel to each other and coated with a fluorescent substance, the anode electrode of each group being connected commonly to each other by wiring, the anode electrodes of one of the first and second groups being disposed as alternating with those of the other group;

a voltage applying means for applying voltages of opposite polarities respectively to the first and second groups of anode electrodes and alternating the polarities of the voltages; and a display controlling means for controlling electron emitting positions on the cathode unit and said voltage applying means, and wherein said plurality of cathodes include a plurality of emitter electrode lines each having a plurality of emitter tips, and a plurality of gate electrode lines formed perpendicular to said emitter electrode lines for attracting electrons emitted from the emitter tips, with an insulation film being interposed therebetween; and said emitter electrode lines extend parallel to the anode electrodes of said anode unit, and are disposed so that each of said emitter electrode lines corresponds in width to two adjacent anode electrodes of the anode; and said fluorescent substance includes a fluorescent substance of a first color, a fluorescent substance of a second color and a fluorescent substance of a third color, which respectively represent the three primary colors, and the anode electrodes of the anode unit are respectively coated with the fluorescent substance of the first color, the fluorescent substance of the second color and the fluorescent substance of the third color in a repeated color sequence of the first color, second color, first color and third color; and anode electrodes coated with the fluorescent substance of the first color constitute the first group of anode electrodes and are all interconnected so as to have an equal potential, while anode electrodes coated with the fluorescent substance of the second color and the fluorescent substance of the third color constitute the second group of anode electrodes and are all interconnected so as to have an equal potential; and comprising the steps of:

applying a voltage to the first group of anode electrodes by the voltage applying means to adjust the potential thereof to a level that allows the anode electrodes of the first group to attract electrons emitted from the cathode and, at the same time, applying a voltage to the second group of anode electrodes by the voltage applying means to adjust the potential thereof to a level that prevents the electrons emitted from the cathode from reaching the anode electrodes of the second group in a first light emission mode for exciting the fluorescent substance of the first color for emission of the first color light; and applying a voltage to the second group of anode electrodes by the voltage applying means to adjust the potential thereof to a level that allows the anode electrodes of the second group to attract electrons emitted from the cathode and, at the same time, applying a voltage to the first group of anode electrodes by the voltage applying means to adjust the potential thereof to a level that prevents the electrons emitted from the cathode from reaching the anode electrodes of the first group in a second light emission mode for exciting the fluorescent substances of the second and third colors for emission of their respective color lights.

7. A method of driving a fluorescent display device comprising:

a cathode unit including a plurality of cathodes arranged in a matrix array;

an anode unit including first and second groups of anode electrodes disposed above said cathode unit, arranged parallel to each other and coated with a fluorescent substance, the anode electrode of each group being connected commonly to each other by wiring, the anode electrodes of one of the first and second groups being disposed as alternating with those of the other group;

a voltage applying means for applying voltages of opposite polarities respectively to the first and second groups of anode electrodes and alternating the polarities of the voltages; and a display controlling means for controlling electron emitting positions on the cathode unit and said voltage applying means; and wherein said plurality of cathodes include a plurality of emitter electrode lines each having a plurality of emitter tips, and a plurality of gate electrode lines formed perpendicular to said emitter electrode lines for attracting electrons emitted from the emitter tips, with an insulation film being interposed therebetween; and said emitter electrode lines extend parallel to the anode electrodes of said anode unit, and are disposed so that each of said emitter electrode lines corresponds in width to two adjacent anode electrodes of the anode; and said fluorescent substance includes a fluorescent substance of a first color, a fluorescent substance of a second color and a fluorescent substance of a third color, which respectively represent the three primary colors, and the anode electrodes of the anode unit are respectively coated with the fluorescent substance of the first color, the fluorescent substance of the second color and the fluorescent substance of the third color in a repeated color sequence of the first color, second color, first color and third color; and anode electrodes coated with the fluorescent substance of the first color constitute the first group of anode electrodes and are all interconnected so as to have an equal potential, while anode electrodes coated with the fluorescent substance of the second color and the fluorescent substance of the third color constitute the second group of anode electrodes and are all interconnected so as to have an equal potential; and a plane including said anode unit is disposed opposite and parallel to a plane including said cathode unit, with the emitter electrode lines of the cathode being located generally just below the anode electrodes coated with the fluorescent substance of the second color and the fluorescent substance of the third color; and comprising the steps of:

applying a predetermined negative potential to all the emitter electrode lines corresponding to the anode electrodes of the first group coated with the fluorescent substance of the first color by the display controlling means when the fluorescent substance of the first color is to be excited for emission of the first color light;

applying a predetermined negative potential to the emitter electrode lines disposed generally just below the anode electrodes of the second group coated with the fluorescent substance of the second color by the display controlling means when the fluorescent substance of the second color is to be excited for emission of the second color light; and applying a predetermined negative potential to the emitter electrode lines disposed generally just below the anode electrodes of the second group coated with the fluorescent substance of the third color by the display controlling means when the fluorescent substance of the third color is to be excited for emission of the third color light.

8. A method as set forth in claim 6, wherein one frame for displaying one screen includes a first field for exciting the fluorescent substance of the first color for emission of the first color light and a second field for exciting the fluorescent substances of the second and third colors for emission of the second and third color lights; and in the first field, said voltage applying means applies voltages of the first light emission mode respectively to the first and second groups of anode electrodes, and said display controlling means scans the gate electrode lines with predetermined time intervals while applying a predetermined negative potential to the emitter electrode lines allowing pixels to exhibit the first color in synchronization with the scanning of the gate electrode lines to drive the first group of anode electrodes coated with the fluorescent substance of the first color; and in the second field, said voltage applying means applies voltages of the second light emission mode respectively to the first and second groups of anode electrodes, and said display controlling means scans the gate electrode lines with predetermined time intervals while applying a predetermined negative potential to the emitter electrode lines allowing pixels to exhibit the second or third color in synchronization with the scanning of the gate electrode lines to drive the second group of anode electrodes coated with the fluorescent substances of the second and third colors.

9. A method of driving a fluorescent display device comprising:

a cathode unit including a plurality of cathodes arranged in a matrix array;

an anode unit including first and second groups of anode electrodes disposed above said cathode unit, arranged parallel to each other and coated with a fluorescent substance, the anode electrode of each group being connected commonly to each other by wiring, the anode electrodes of one of the first and second groups being disposed as alternating with those of the other group;

a voltage applying means for applying voltages of opposite polarities respectively to the first and second groups of anode electrodes and alternating the polarities of the voltages; and a display controlling means for controlling electron emitting positions on the cathode unit and said voltage applying means, and wherein said plurality of cathodes include a plurality of emitter electrode lines each having a plurality of emitter tips, and a plurality of gate electrode lines formed perpendicular to said emitter electrode lines for attracting electrons emitted from the emitter tips, with an insulation film being interposed therebetween; and said emitter electrode lines extend parallel to the anode electrodes of said anode unit, and are disposed so that each of said emitter electrode lines corresponds in width to two adjacent anode electrodes of the anode; and said fluorescent substance includes a fluorescent substance of a first color, a fluorescent substance of a second color and a fluorescent substance of a third color, which respectively represent the three primary colors, and the anode electrodes of the anode unit are respectively coated with the fluorescent substance of the first color, the fluorescent substance of the second color and the fluorescent substance of the third color in a repeated color sequence of the first color, second color, first color and third color; and anode electrodes coated with the fluorescent substance of the first color constitute the first group of anode electrodes and are all interconnected so as to have an equal potential, while anode electrodes coated with the fluorescent substance of the second color and the fluorescent substance of the third color constitute the second group of anode electrodes and are all interconnected so as to have an equal potential; and comprising the steps of:

applying a voltage to the first group of anode electrodes by the voltage applying means to adjust the potential thereof to a level that allows the anode electrodes of the first group to attract electrons emitted from the cathode and, at the same time, applying a voltage to the second group of anode electrodes by the voltage applying means to adjust the potential thereof to a level that prevents the electrons emitted from the cathode from reaching the anode electrodes of the second group in a first light emission mode for exciting the fluorescent substance of the first color for emission of the first color light; and applying a voltage to the second group of anode electrodes by the voltage applying means to adjust the potential thereof to a level that allows the anode electrodes of the second group to attract electrons emitted from the cathode and, at the same time, applying a voltage to the first group of anode electrodes by the voltage applying means to adjust the potential thereof to a level that prevents the electrons emitted from the cathode from reaching the anode electrodes of the first group in a second light emission mode for exciting the fluorescent substances of the second and third colors for emission of their respective color lights, wherein said display controlling means scans n gate electrode lines in succession with predetermined time intervals in one frame for displaying one screen; and in a first or second half of a scanning period of an i-th (i=1 to N) gate electrode line, said voltage applying means applies the voltages of the first light emission mode respectively to the first and second groups of anode electrodes, while the display controlling means applies a predetermined negative potential to the emitter electrode lines allowing pixels to exhibit the first color to drive the first group of anode electrodes coated with the fluorescent substance of the first color; and in a second or first half of the scanning period of the i-th (i=1 to N) gate electrode line, said voltage applying means applies the voltages of the second light emission mode respectively to the first and second groups of anode electrodes, while the display controlling means applies a predetermined negative potential to the emitter electrode lines allowing pixels to exhibit the second or third color to drive the second group of anode electrodes coated with the fluorescent substances of the second and third colors.

* * * * *